US008919302B2

(12) United States Patent
Hamakawa et al.

(10) Patent No.: US 8,919,302 B2
(45) **Date of Patent: *Dec. 30, 2014**

(54) COOLING STRUCTURE FOR INTERNAL COMBUSTION ENGINE

(75) Inventors: Takeru Hamakawa, Wako (JP); Atsushi Nakajima, Wako (JP); Yoshihiro Akiyama, Wako (JP); Yoshihisa Kazui, Wako (JP); Takeshi Fujii, Wako (JP); Kuniyasu Tamura, Wako (JP); Yoshiyuki Iida, Chiba (JP)

(73) Assignee: Honda Motor Co., Ltd., Tokyo (JP)

( * ) Notice: Subject to any disclaimer, the term of this patent is extended or adjusted under 35 U.S.C. 154(b) by 382 days.

This patent is subject to a terminal disclaimer.

(21) Appl. No.: 12/940,552

(22) Filed: Nov. 5, 2010

(65) Prior Publication Data

US 2011/0132295 A1 Jun. 9, 2011

(30) Foreign Application Priority Data

Nov. 19, 2009 (JP) ..... 2009-264144
Nov. 19, 2009 (JP) ..... 2009-264150
Nov. 19, 2009 (JP) ..... 2009-264168

(51) Int. Cl.

| | |
|---|---|
| ***F02F 1/14*** | (2006.01) |
| ***F02B 75/18*** | (2006.01) |
| ***F02F 1/10*** | (2006.01) |
| ***F01P 1/02*** | (2006.01) |
| *F01P 3/02* | (2006.01) |

(52) U.S. Cl.

CPC ..... *F02F 1/14* (2013.01); *F01P 2003/021* (2013.01)

USPC ..... 123/41.79; 123/41.74; 123/41.72; 123/41.67

(58) Field of Classification Search

USPC ..... 123/41.67, 41.72, 41.81, 41.79

See application file for complete search history.

(56) References Cited

U.S. PATENT DOCUMENTS

| | | | | |
|---|---|---|---|---|
| 7,438,026 | B2 * | 10/2008 | Nakada et al. | 123/41.74 |
| 8,091,518 | B2 * | 1/2012 | Shikida et al. | 123/41.74 |
| 2003/0230254 | A1 * | 12/2003 | Matsutani et al. | 123/41.79 |
| 2005/0028758 | A1 * | 2/2005 | Hughes et al. | 123/41.74 |
| 2005/0217614 | A1 * | 10/2005 | Matsutani et al. | 123/41.74 |
| 2005/0235930 | A1 * | 10/2005 | Xin | 123/41.74 |
| 2008/0060593 | A1 * | 3/2008 | Nakada et al. | 123/41.79 |
| 2009/0031978 | A1 * | 2/2009 | Kobayashi et al. | 123/142.5 R |

FOREIGN PATENT DOCUMENTS

| | | |
|---|---|---|
| JP | 2002-021632 A | 1/2002 |
| JP | 2005-030297 A | 2/2005 |
| JP | 2005-076601 A | 3/2005 |
| JP | 2005-083258 A | 3/2005 |

(Continued)

*Primary Examiner* — Noah Kamen
*Assistant Examiner* — Syed O Hasan
(74) *Attorney, Agent, or Firm* — Mori & Ward, LLP

(57) ABSTRACT

A spacer arranged inside a water jacket which is formed to surround peripheries of cylinder bores in a cylinder block of an internal combustion engine includes support legs extending in an up-and-down direction from a spacer main body part which partitions the water jacket into an upper and lower cooling water passages. The support legs are disposed in opposite end portions in a cylinder row line direction, where the temperatures of the cylinder bores tend to be lower. Accordingly, even if the flow of cooling water is more or less inhibited by the support legs and the cooling effect deteriorates, it is possible to prevent the temperatures of the respective cylinder bores from becoming different by suppressing the influence to a minimum.

15 Claims, 24 Drawing Sheets

(56) References Cited

FOREIGN PATENT DOCUMENTS

| | | | |
|---|---|---|---|
| JP | 2005-120949 | A | 5/2005 |
| JP | 2006-207459 | A | 8/2006 |
| JP | 2007-071039 | A | 3/2007 |
| JP | 2007-107426 | A | 4/2007 |
| JP | 2007-113414 | A | 5/2007 |
| JP | 2007-127066 | A | 5/2007 |
| JP | 2007-187107 | A | 7/2007 |
| JP | 2008-208744 | A | 9/2008 |
| JP | 4149322 | B2 | 9/2008 |
| JP | 2009-257104 | A | 11/2009 |
| WO | WO 2008/010584 | A1 | 1/2008 |

* cited by examiner

EMBODIMENT

COMPARATIVE EXAMPLE

COOLING STRUCTURE FOR INTERNAL COMBUSTION ENGINE

BACKGROUND OF THE INVENTION

1. Field of the Invention

The present invention relates to a cooling structure for an internal combustion engine, in which: a spacer is fitted inside a water jacket which is formed to surround peripheries of a plurality of cylinder bores arranged one after another on a cylinder row line of a cylinder block of the internal combustion engine; and a cooling condition of the cylinder bores is controlled by regulating a flow of cooling water in the water jacket by use of the spacer.

2. Description of the Related Art

Japanese Patent No. 4149322 has made publicly known a cooling structure for an internal combustion engine in which: six spacers for inhibiting the flow of cooling water are arranged inside a water jacket which surrounds peripheries of three cylinder bores arranged in a straight line; an upper support leg and a lower support leg respectively project upward and downward from a spacer main body part of each spacer; and the spacers are positioned in the water jacket in an up-and-down direction by use of those support legs.

Meanwhile, in the conventional cooling structure for an internal combustion engine, however, the six spacers are arranged at the farthest positions from a cylinder row line on the intake side and the exhaust side in the water jacket. For this reason, due to the support legs, each portion in which the corresponding spacer is arranged has a smaller cross-sectional area of the water jacket than two sides of the portion in which the spacer is arranged. This leads to a problem that: the flow of the cooling water is obstructed around the support legs; and the cooling performance is deteriorated.

The temperature of each cylinder bore tends to become higher particularly in the intake-side and exhaust-side positions with respect to the cylinder row line than in positions of the two end portions in the cylinder row line direction. When the flow of the cooling water is obstructed as a result of providing the support legs in the areas where the temperatures tend to become higher, the temperatures of the respective cylinder bores are likely to become nonuniform.

SUMMARY OF THE INVENTION

The present invention has been made in view of the above-described situation. An object of the present invention is to make the temperatures of multiple cylinder bores uniform with a spacer fitted in a water jacket surrounding the multiple cylinder bores.

In order to achieve the object, according to a first feature of the present invention, there is provided a cooling structure for an internal combustion engine, in which: a spacer is fitted inside a water jacket which is formed to surround peripheries of a plurality of cylinder bores arranged one after another on a cylinder row line of a cylinder block of the internal combustion engine; and a cooling condition of the cylinder bores is controlled by regulating a flow of cooling water in the water jacket by use of the spacer, wherein the spacer comprises a fixing part which is disposed in an area where influence of the fixing part on the flow of the cooling water is small and which fixes the spacer inside the water jacket.

In the foregoing configuration, the spacer is fitted inside the water jacket which is formed to surround the peripheries of the cylinder bores in the cylinder block of the internal combustion engine. For this reason, the cylinder bores are thermally insulated by regulating the flow of the cooling water in the water jacket by use of the spacer. Thereby, the cylinder bores are thermally expanded, and friction between the cylinder bores and the corresponding pistons can be reduced. In addition, the spacer includes the fixing part, which fixes the spacer inside the water jacket, in the area where the influence of the fixing part on the flow of the cooling water is small. For this reason, the flow of the cooling water in the water jacket is made uniform, and temperatures of the multiple cylinder bores can be made uniform.

According to a second feature of the present invention, in addition to the first feature, the fixing part is disposed in an end portion in a direction of the cylinder row line, or in a connecting portion of a spacer main body part which faces an area where two of the cylinder bores are adjacent to each other.

In the foregoing configuration, the fixing part is disposed in the end portion in the cylinder row line direction, or in the connecting portion of the spacer main body part which faces the area where the cylinder bores are adjacent to each other. For this reason, the influence of the providing of the fixing part on the cooling effect of the cooling water can be suppressed to a minimum.

According to a third feature of the present invention, in addition to the second feature, the spacer comprises a support leg which extends in an up-and-down direction from the spacer main body part for regulating the flow of the cooling water in the water jacket, and which forms the fixing part, and the support leg is disposed in the end portion in the cylinder row line direction.

In the foregoing configuration, the spacer includes the support leg which extends in the up-and-down direction from the spacer main body part for regulating the flow of the cooling water in the water jacket, and the support leg is disposed in the end portion in the cylinder row line direction, where the temperature of the cylinder bore tends to be lower. For this reason, even if the flow of the cooling water is more or less inhibited by the support leg and the cooling effect deteriorates, it is possible to prevent the temperatures of the respective cylinder bores from becoming different by suppressing the influence to a minimum.

According to a fourth feature of the present invention, in addition to the third feature, the support leg curves so as to form an arc-shape along an inner wall surface or an outer wall surface of the water jacket.

In the foregoing configuration, the support leg extends along the inner wall surface or the outer wall surface of the water jacket while curving so as to form an arc-shape. For this reason, the flow of the cooling water in the water jacket can be regulated by the support leg.

According to a fifth feature of the present invention, in addition to the third or fourth feature, the support leg is disposed offset toward an inner wall surface of the water jacket.

In the foregoing configuration, the support leg is disposed offset toward the inner wall surface of the water jacket. This makes it hard for the cooling water to intervene between the support leg and the inner wall surface of the water jacket. Thereby, the cylinder bores disposed in the respective opposite end portions in the cylinder row line direction, which tend to become lower in temperature, are prevented from being cooled too much. Accordingly, it is possible to more effectively inhibit the temperatures of the respective cylinder bores from becoming different.

According to a sixth feature of the present invention, in addition to the second feature, the spacer comprises a support leg which extends in an up-and-down direction from the spacer main body part for regulating the flow of the cooling water in the water jacket, and which forms the fixing part, and the support leg is disposed in the connecting portion of the spacer main body part which faces the area where the two cylinder bores are adjacent to each other.

In the foregoing configuration, the spacer includes the support leg which extends in the up-and-down direction from the spacer main body part for regulating the flow of the cooling water in the water jacket, and the support leg is disposed in the connecting portions of the spacer, which are wider as the result of facing the area where the cylinder bores are adjacent to each other. For this reason, the smooth flow of the cooling water can be achieved by minimizing the influence of the providing of the support leg on the decreases in the passage cross-sectional area of the water jacket.

According to a seventh feature of the present invention, in addition to the sixth feature, a passage width of the water jacket is larger in an area where the connecting portion is disposed than in any other area.

In the foregoing configuration, the passage width of the water jacket is larger in the area where the connecting portion is disposed than in any other portions. For this reason, the influence of the disposition of the support leg in the connecting portions on the flow of the cooling water can be further suppressed to a minimum.

According to an eighth feature of the present invention, in addition to the sixth or seventh feature, the spacer comprises a partition wall which extends from the spacer main body part in the up-and-down direction on one of opposite end sides in the cylinder row line direction, and which partitions between a cooling water supply port and a cooling water discharge port of the water jacket, and the support leg is disposed in the connecting portion closest to the other of the opposite end sides in the cylinder row line direction.

In the foregoing configuration, the spacer includes the partition wall which extends from the spacer main body part in the up-and-down direction, and which partitions between the cooling water supply port and the cooling water discharge port of the water jacket, on one of the opposite end sides in the cylinder row line direction. For this reason, the partition wall prevents the cooling water from taking a short cut from the cooling water supply port to the cooling water discharge port, and the cooling effect can be secured. In this respect, the support leg is disposed in the connecting portion closest to the other of the opposite end sides in the cylinder row line direction. For this reason, the distance between the partition wall and the support leg is secured to a maximum, and the stable support of the spacer can be achieved.

According to a ninth feature of the present invention, in addition to the second feature, a fixing member for fixing the spacer inside the water jacket is provided in an end portion of the spacer in the cylinder row line direction.

In the foregoing configuration, the fixing member is provided in the end portion of the spacer in the cylinder row line direction, whose rigidity is higher. The spacer is fixed inside the water jacket by use of this fixing member. For this reason, the fixing member not only hardly obstructs the flow of the cooling water in the cylinder row line direction, but also can fix the spacer to the water jacket with higher strength.

According to a tenth feature of the present invention, in addition to the ninth feature, the fixing member is provided in each of the opposite end portions of the spacer in the cylinder row line direction, and is put in pressure contact with an inner wall surface of the water jacket.

In the foregoing configuration, the fixing members provided in the respective opposite end portions of the spacer in the cylinder row line direction are put in pressure contact with the inner wall surface of the water jacket. For this reason, the spacer is stretched outward in the cylinder row line direction by reaction forces which the fixing members receive from the inner wall surface of the water jacket, and accordingly deforms in such a way that the intake-side and exhaust-side inner peripheral surfaces of the spacer come closer to the inner wall surface of the water jacket. Thereby, not only can the effect of thermally insulating the cylinder bores be enhanced by making it hard for the cooling water to contact the inner wall surface of the water jacket, but also it is possible to make it hard for hitting sounds of the pistons to be propagated to the cylinder block through the spacer.

According to an eleventh feature of the present invention, in addition to the tenth feature, the fixing members are each made of an elastic body.

In the foregoing configuration, the fixing members are each made of the elastic body. For this reason, load for stretching the spacer outward in the cylinder row line direction can be produced by use of the resilient forces of the respective fixing members which are put in pressure contact with the inner wall surface of the water jacket.

According to a twelfth feature of the present invention, in addition to the ninth, tenth or eleventh feature, the fixing members are symmetrically disposed in the respective opposite end portions in the cylinder row line direction.

In the foregoing configuration, the fixing members are symmetrically disposed in the respective opposite end portions on the cylinder row line. For this reason, the load by the fixing members acts to stretch the spacer in the cylinder row line direction precisely and efficiently, and deforms the intake-side side surface and the exhaust-side side surface of the spacer symmetrically. Accordingly, all the peripheries of the cylinder bores can be cooled uniformly.

According to a thirteenth feature of the present invention, in addition to the ninth, tenth or eleventh feature, the spacer comprises a spacer main body part separating the water jacket into an upper cooling water passage and a lower cooling water passage, and the fixing member is provided to the spacer main body part.

In the foregoing configuration, the spacer includes the spacer main body part for separating the water jacket into the upper cooling water passage and the lower cooling water passage, and the fixing member is provided to the spacer main body part. For this reason, t is possible to prevent the passage cross-sectional areas of the upper cooling water passage and the lower cooling water passage from deceasing due to the providing of the fixing member.

According to a fourteenth feature of the present invention, in addition to the ninth, tenth or eleventh feature, the spacer comprises a lower support leg which extends downward from the fixing member, and which contacts a bottom portion of the water jacket.

In the foregoing configuration, the spacer includes the lower support leg which extends downward from the fixing member, and which contacts the bottom portion of the water jacket. For this reason, when the spacer is forced into the water jacket toward its bottom portion and the lower end of the lower support leg receives a reaction force as a result of being brought into contact with the bottom portion of the water jacket, it is possible to prevent the spacer from deforming in a twisted manner.

Here, note that an upper support leg 14*e*, a lower support leg 14*f*, an upper support leg 14*g* and a lower support leg 14*h* of a first embodiment correspond to the fixing part or the support leg of the present invention; an upper support leg 14*i* and a lower support leg 14*j* of a second embodiment correspond to the fixing part or the support leg of the present invention; and communication holes 15*a*, 15*b* of the second embodiment correspond to the cooling water discharge port of the present invention.

The above description, other objects, characteristics and advantages of the present invention will be clear from detailed descriptions which will be provided for the preferred embodiment referring to the attached drawings.

BRIEF DESCRIPTION OF THE DRAWINGS

FIGS. 1 to 12C show a first embodiment of the present invention:

FIG. 1 is a perspective view of a cylinder block of an internal combustion engine with four cylinders mounted in a straight line;

FIG. 2 is a perspective view of a spacer;

FIG. 3 is a view seen from a direction of an arrow 3 in FIG. 1;

FIG. 4 is a view seen from a direction of an arrow 4 in FIG. 3;

FIG. 5 is a sectional view taken along a line 5-5 in FIG. 3;

FIG. 6 is an enlarged view of a part indicated by an arrow 6 in FIG. 5;

FIG. 7 is a sectional view taken along a line 7-7 in FIG. 3;

FIG. 8 is a sectional view taken along a line 8-8 in FIG. 3;

FIG. 9 is a sectional view taken along a line 9-9 in FIG. 3;

FIG. 10 is a sectional view taken along a line 10-10 in FIG. 3;

FIG. 12C is a sectional view taken along a line C-C in FIG. 12B.

FIGS. 13 to 23B show a second embodiment of the present invention:

FIG. 13 is a perspective view of one bank of a V-type internal combustion engine with six cylinders;

FIG. 14 is a view seen from a direction of an arrow 14 in FIG. 13;

FIG. 15 is a view seen from a direction of an arrow 15 in FIG. 13;

FIG. 16 is a view seen from a direction of an arrow 16 in FIG. 13;

FIG. 17 is a sectional view taken along a line 17-17 in FIG. 14;

FIG. 18 is a sectional view taken along a line 18-18 in FIG. 14;

FIG. 19 is a sectional view taken along a line 19-19 in FIG. 14;

FIG. 20 is an enlarged view of a part indicated by an arrow 20 in FIG. 14;

FIG. 21 is a sectional view taken along a line 21-21 in FIG. 20;

FIG. 22 is a sectional view taken along a line 22-22 in FIG. 20;

FIG. 23B is a view related to the second embodiment and seen from the direction of the arrow 23 in FIG. 16.

BRIEF DESCRIPTION OF THE DRAWINGS

Descriptions will be hereinbelow provided for a first embodiment of the present invention on the basis of FIGS. 1 to 12C.

Figure 1:
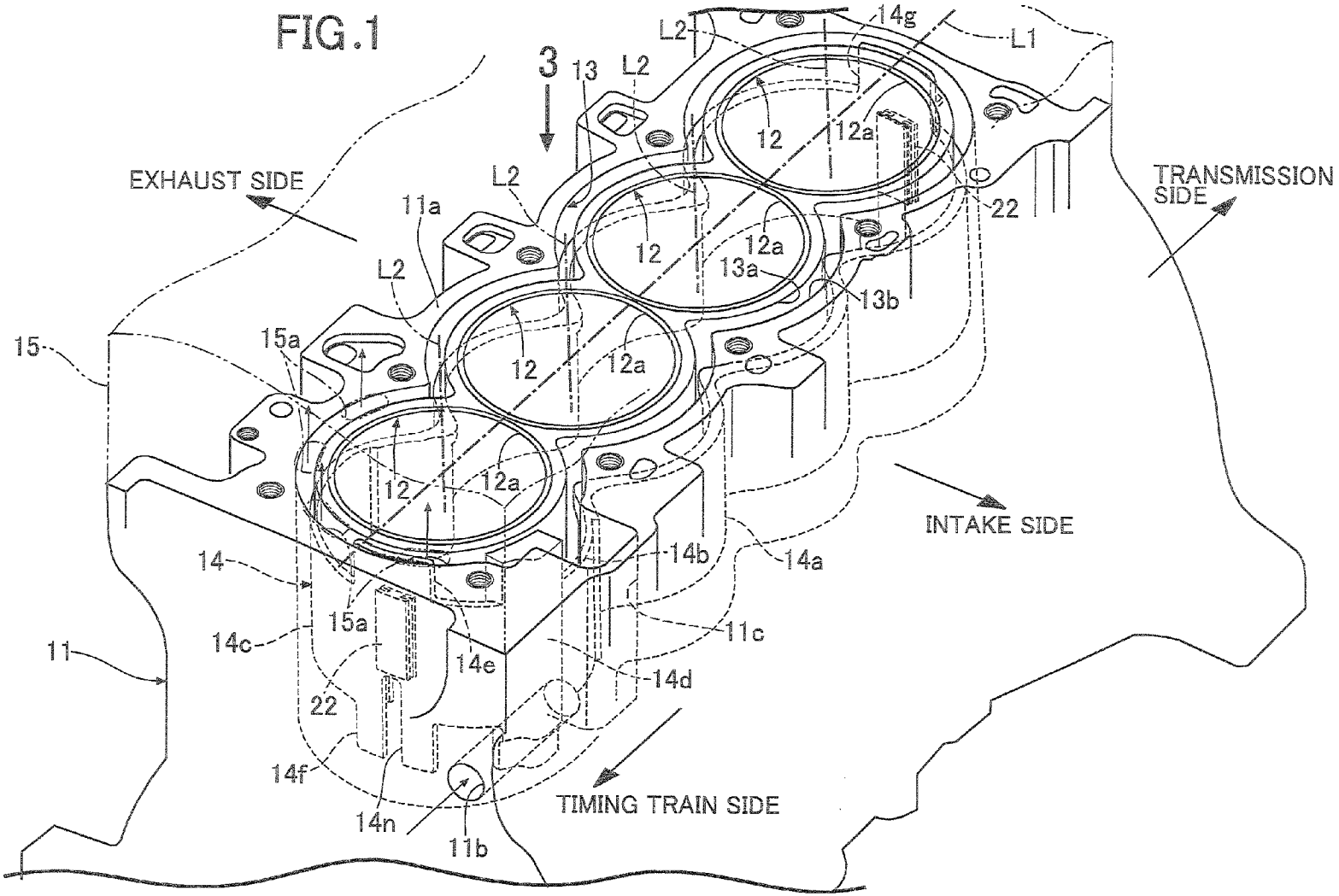

As shown in FIG. 1, four cylinder sleeves 12 are embedded along a cylinder row line L1 in a cylinder block 11 of an internal combustion engine with four cylinders mounted in a straight line. A water jacket 13 is formed to surround the outer peripheral surfaces of the respective cylinder sleeves 12. The cylinder block 11 according to this embodiment is of a Siamese type, and no portion of the water jacket 13 is formed between each neighboring two of the cylinder sleeves 12. Thereby, the shortening of the dimension of the internal combustion engine in the cylinder row line L1 direction is achieved. The water jacket 13 opened in a deck surface 11*a* of the cylinder block 11 extends downward from the deck surface 11*a* toward a crankcase up to a certain depth. A spacer 14 made of a synthetic resin is arranged in an interstice between an inner wall surface 13*a* and an outer wall surface 113*b* of the water jacket 13. The spacer 14 is inserted in the interstice therebetween from the opening in the deck surface 11*a* of the cylinder block 11.

Note that with regard to an "up-and-down direction" in this description, the cylinder head side in a cylinder axis line L2 direction is defined as "upper," and the crankcase side in the cylinder axis line L2 direction is defined as "lower."

As clear from FIGS. 1 to 5, the spacer 14 includes a spacer main body part 14*a*, a cooling water inlet port part 14*b* and a cooling water outlet port part 14*c*. The entire peripheries of four cylinder bores 12*a* in the cylinder bock 11 are surrounded by the spacer main body part 14*a*, the cooling water inlet port part 14*b* and the cooling water outlet port part 14*c*. The cooling water inlet port part 14*b* surrounds an intake-side portion of one cylinder bore 12*a* which is situated on a first end side in the cylinder row line L1 direction (on a timing train side). The cooling water outlet port part 14*c* surround the first end-side portion of the cylinder bore 12*a* in the cylinder row line L1 direction and an exhaust side-portion of the cylinder bore 12*a*. A partition wall 14*d* is integrally provided in a position which is slightly offset from the first end-side portion of the spacer 14 in the cylinder row line L1 direction to the intake-side portion of the space 14, and which intervenes between the cooling water inlet port part 14*b* and the cooling water outlet port part 14*c*. The partition wall 14*d* is formed thicker than the spacer main body part 14*a*, and projects upward from the upper edges of the cooling water inlet port part 14*b* and the cooling water outlet port part 14*c*, and downward from the lower edges of the cooling water inlet port part 14*b* and the cooling water outlet port part 14*c*.

Inside the water jacket 13, an upper cooling water passage 13*c* surrounding the peripheries of the respective four cylinder bores 12*a* is formed between the upper edge of the spacer main body part 14*a* and an undersurface of a cylinder head 15. In addition, a lower cooling water passage 13*d* surrounding the peripheries of the respective four cylinder bores 12*a* is formed between the lower edge of the spacer main body part 14*a* and the bottom portion of the water jacket 13.

An upper support leg 14*e* and a lower support leg 14*f* project to the insides of the upper cooling water passage 13*c* and the lower cooling water passage 13*d*, respectively, from a position at which the cylinder row line L1 intersects the cooling water outlet port part 14*c* on its first end side. In addition, an upper support leg 14*g* and a lower support leg 14*h* project to the insides of the upper cooling water passage 13*c* and the lower cooling water passage 13*d*, respectively, from a position at which the cylinder row line L1 intersects the spacer main body part 14*a* on its second end side (on the side closer to a transmission). For this reason, when the spacer 14 is attached to the inside of the water jacket 13, the lower ends of the respective paired lower support legs 14*f*, 14*h* are in contact with the bottom portion of the water jacket 13, and the upper ends of the respective paired upper support legs 14*e*, 14*g* are in contact with the undersurface of a gasket 16 held between the cylinder block 11 and the cylinder head 15, in the opposite end portions in the cylinder row line L1 direction. Thereby, the spacer 14 is positioned in the up-and-down direction.

Pistons 18 connected to a crankshaft 17 are slidably fitted in the respective cylinder bores 12*a*. Top rings 19, second rings 20 and oil rings 21 are attached to top parts 18*a* of the pistons 18, respectively.

Descriptions will be hereinbelow provided for the detailed structure of the spacer 14 sequentially.

Figure 3:
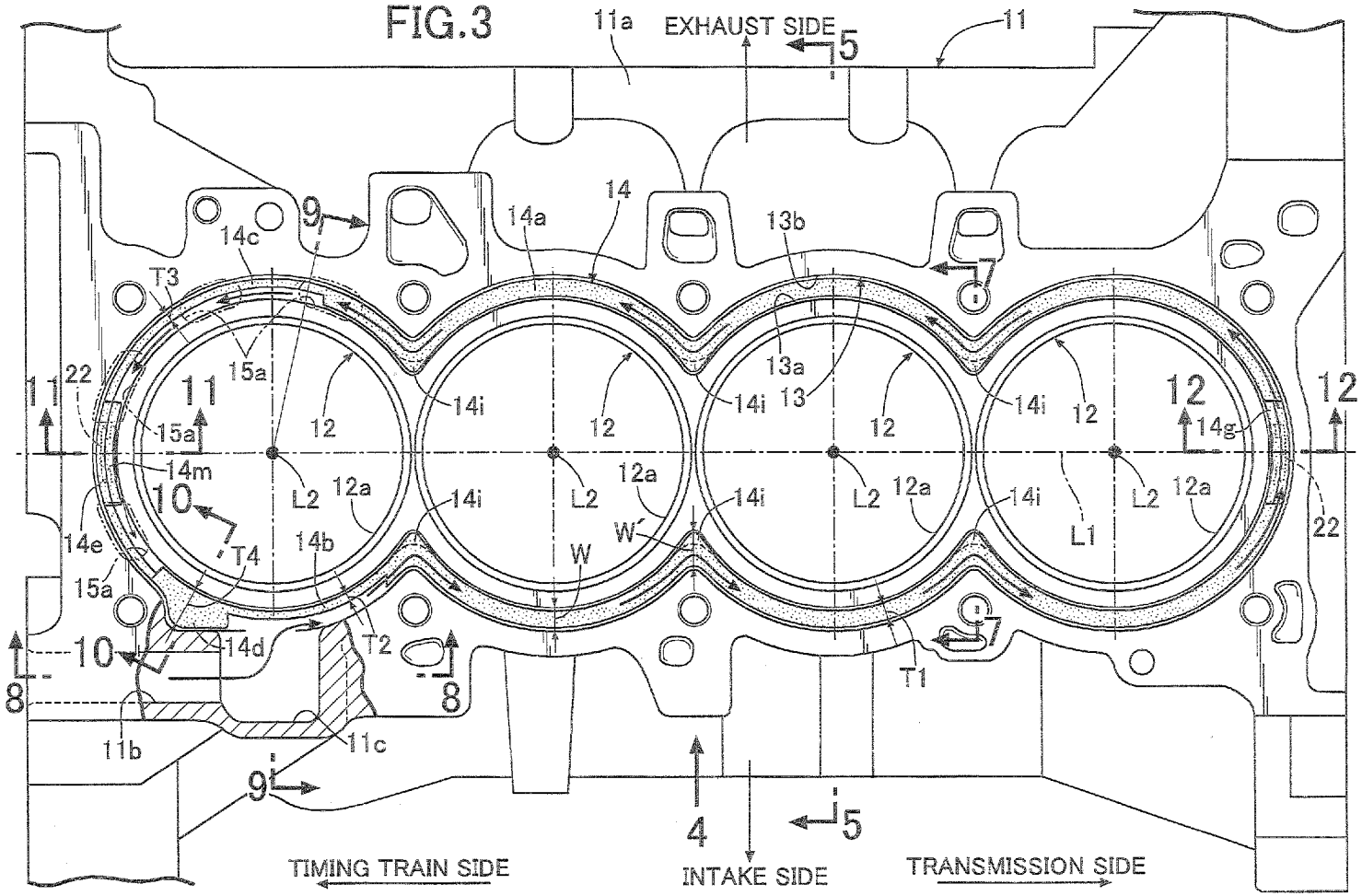
Figure 4:
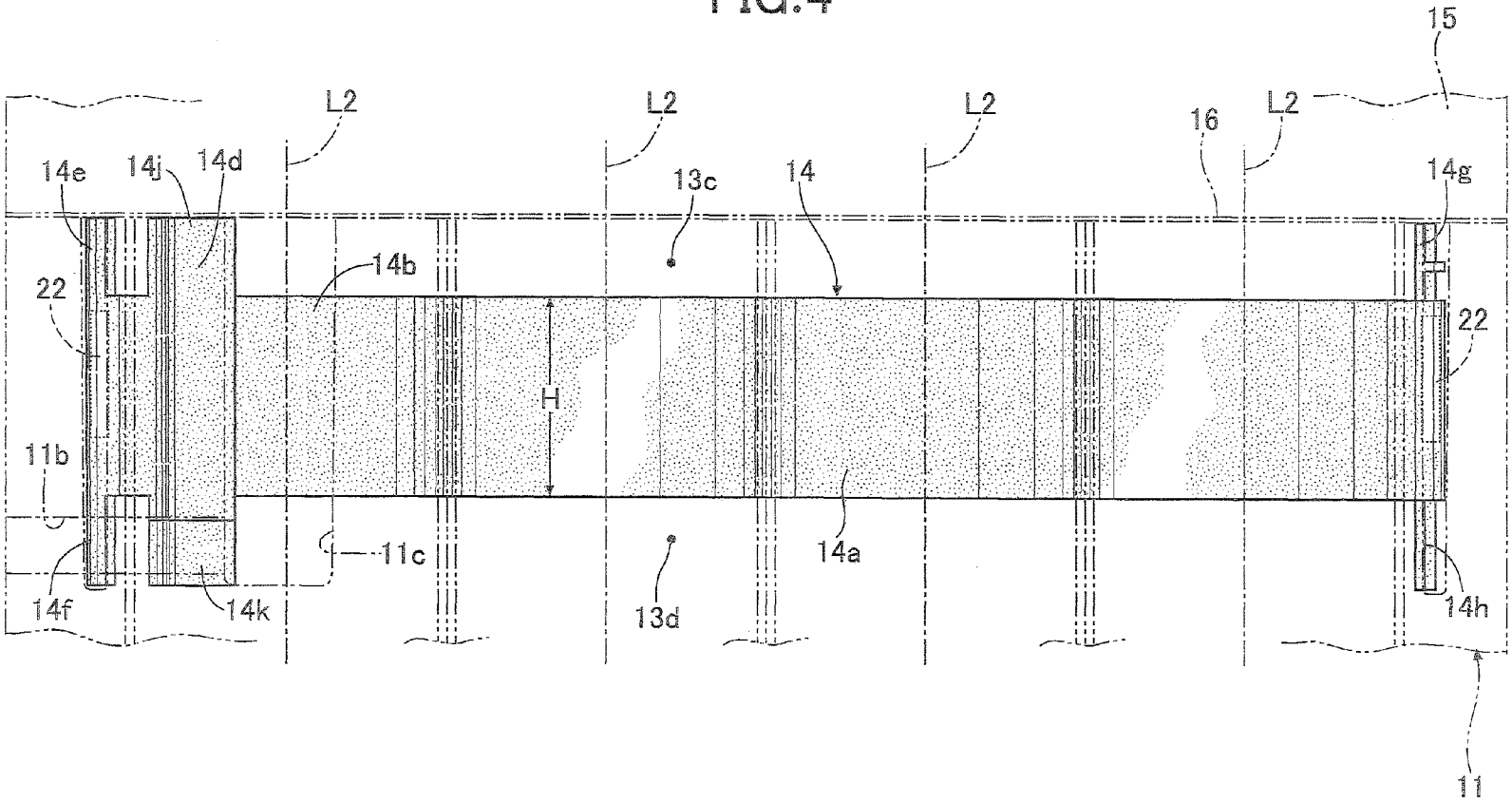

As clear from FIG. 4, the heights of the spacer main body part 14*a*, the cooling water inlet port part 14*b* and the cooling water outlet port part 14*c* of the spacer 14 in a cylinder axis line L2 direction are constant H throughout peripheries thereof. As clear from FIGS. 2 and 3, the thickness T1 of the spacer main body part 14*a* is basically constant. However, the thickness T2 of the cooling water inlet port part 14*b* is thinner than the thickness T1 of the spacer main body part 14*a*, and the thickness T3 of the cooling water outlet port part 14*c* is thinner than the thickness T1 of the spacer main body part 14*a*. In addition, the thickness T4 of the partition wall 14*d* is thicker than the thickness T1 of the spacer main body part 14*a*. The inner peripheral surface of the cooling water inlet port part 14*b* is flush with the inner peripheral surface of the spacer main body part 14*a*. The outer peripheral surface of the cooling water inlet port part 14*b* is offset inward in a radial direction from the outer peripheral surface of the spacer main body part 14*a* by a step. Furthermore, the outer peripheral surface of the cooling water outlet port part 14*c* is flush with the outer peripheral surface of the spacer main body part 14*a*. The inner peripheral surface of the cooling water outlet port part 14*c* is offset outward in the radial direction from the inner peripheral surface of the spacer main body part 14*a* by a step.

Figure 5:
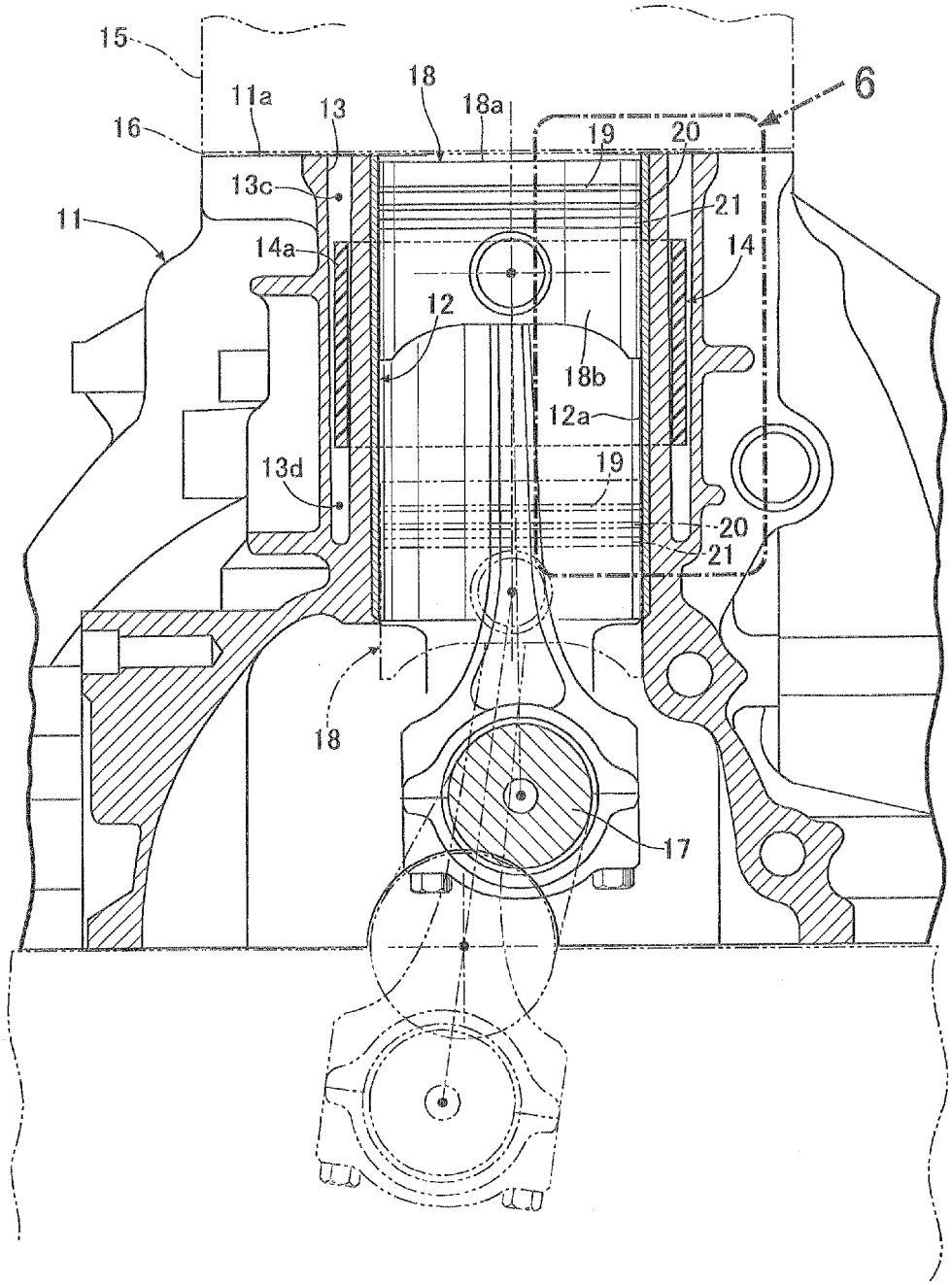

As clear from FIG. 5, while the pistons 18 are moving in the respective cylinder bores 12*a* up and down in response to rotation of the crankshaft 17, side thrusts acting between the pistons 18 and the cylinder bores 12*a* change periodically. Each side thrust reaches a maximum when the corresponding one of the pistons 18 reaches a position of the expansion stroke which is indicated by the continuous line (for example, a position where the crank angle is at 15° after the compression top dead center). The up-and-down position of the spacer 14 inside the water jacket 13 is set in such a way that the top ring 19, the second ring 20 and the oil ring 21 of each of the pistons 18 are located above the upper edge of the spacer 14, and a skirt part 18*b* of the piston 18 is located below the upper edge of the spacer 14 when the piston 18 is located at the position maximizing the side thrust. Furthermore, the up-and-down position of the spacer 14 inside the water jacket 13 is set in such a way that the top ring 19, the second ring 20 and the oil ring 21 of each of the pistons 18 are located below the lower edge of the spacer 14 when the piston 18 is located at the bottom dead center position indicated by the chain line.

Figure 6:
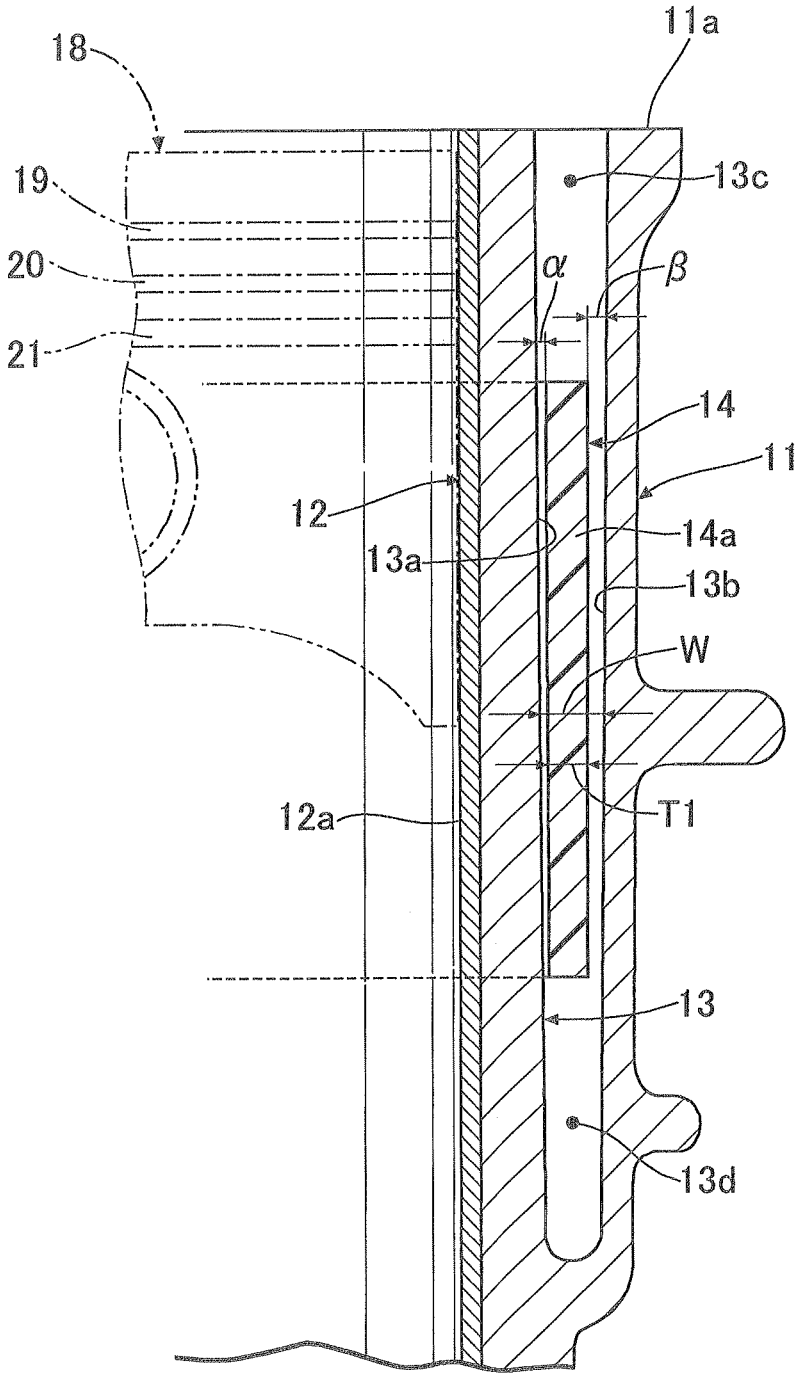

As clear from FIG. 6, the thickness T1 of the spacer main body part 14*a* is set slightly less than the width W of the water jacket 13 in which the spacer main body part 14*a* is fitted. The reason for this is to prevent the assemblability from deteriorating due to friction of the spacer 14 with the inner wall surface 13*a* and the outer wall surface 13*b* of the water jacket 13 resulting from the fact that the dimensional precision of the inner wall surface 13*a* and the outer wall surface 13*b* of the water jacket 13, which have been subjected to no process since casted, is not high. Accordingly, when the spacer 14 is assembled inside the water jacket 13, a space α is formed between the inner peripheral surface of the spacer main body part 14*a* and the inner wall surface 13*a* of the water jacket 13, and a space β is formed between the outer peripheral surface of the spacer main body part 14*a* and the outer wall surface 13*b* of the water jacket 13. The spacer main body part 14*a* is arranged therein in such a way that the space α is set smaller than the space β, that is to say, the spacer main body part 14*a* is closer to the inner wall surface 13*a* of the water jacket 13 than to the outer wall surface 13*b* thereof.

Figure 7:
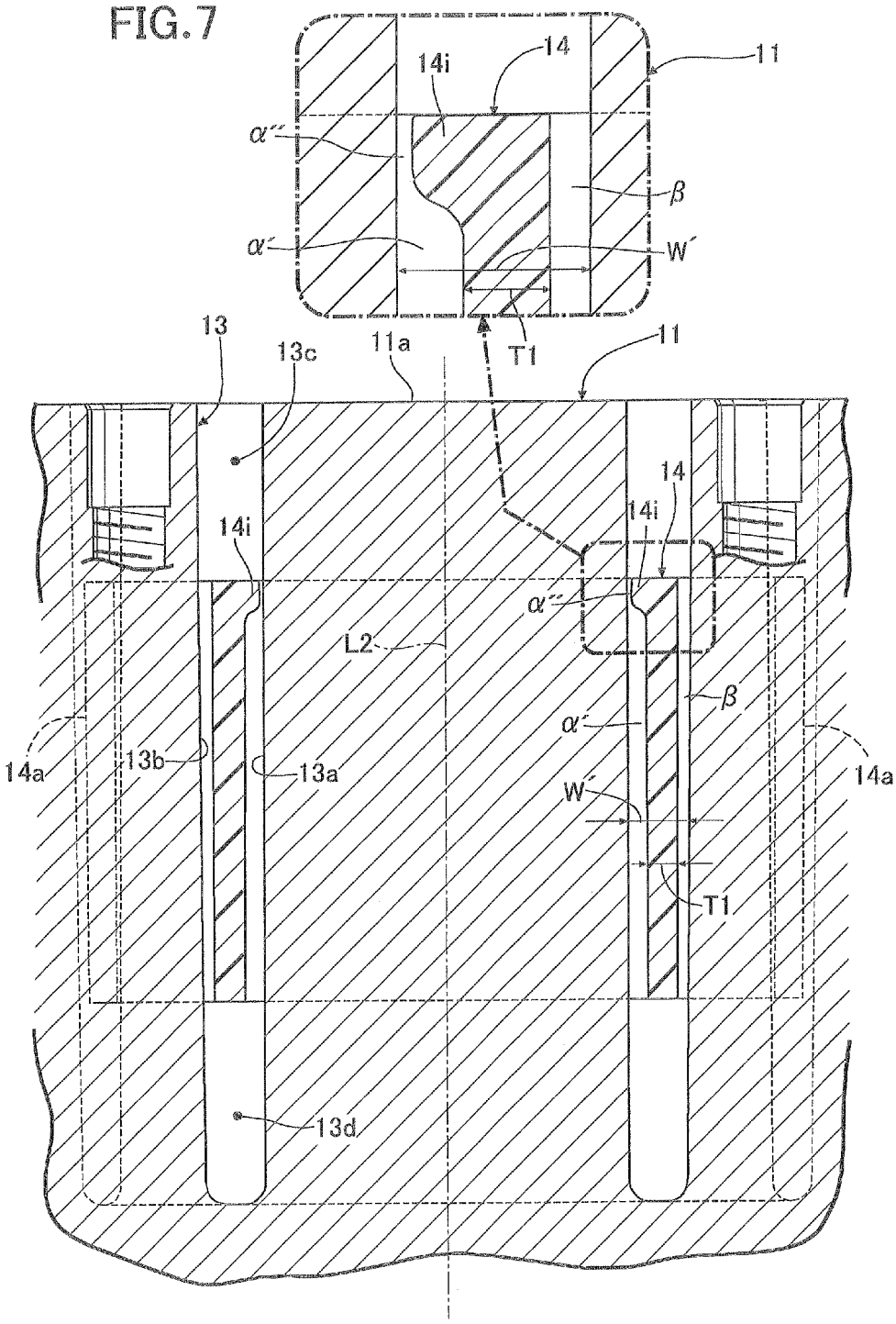
Figure 8:
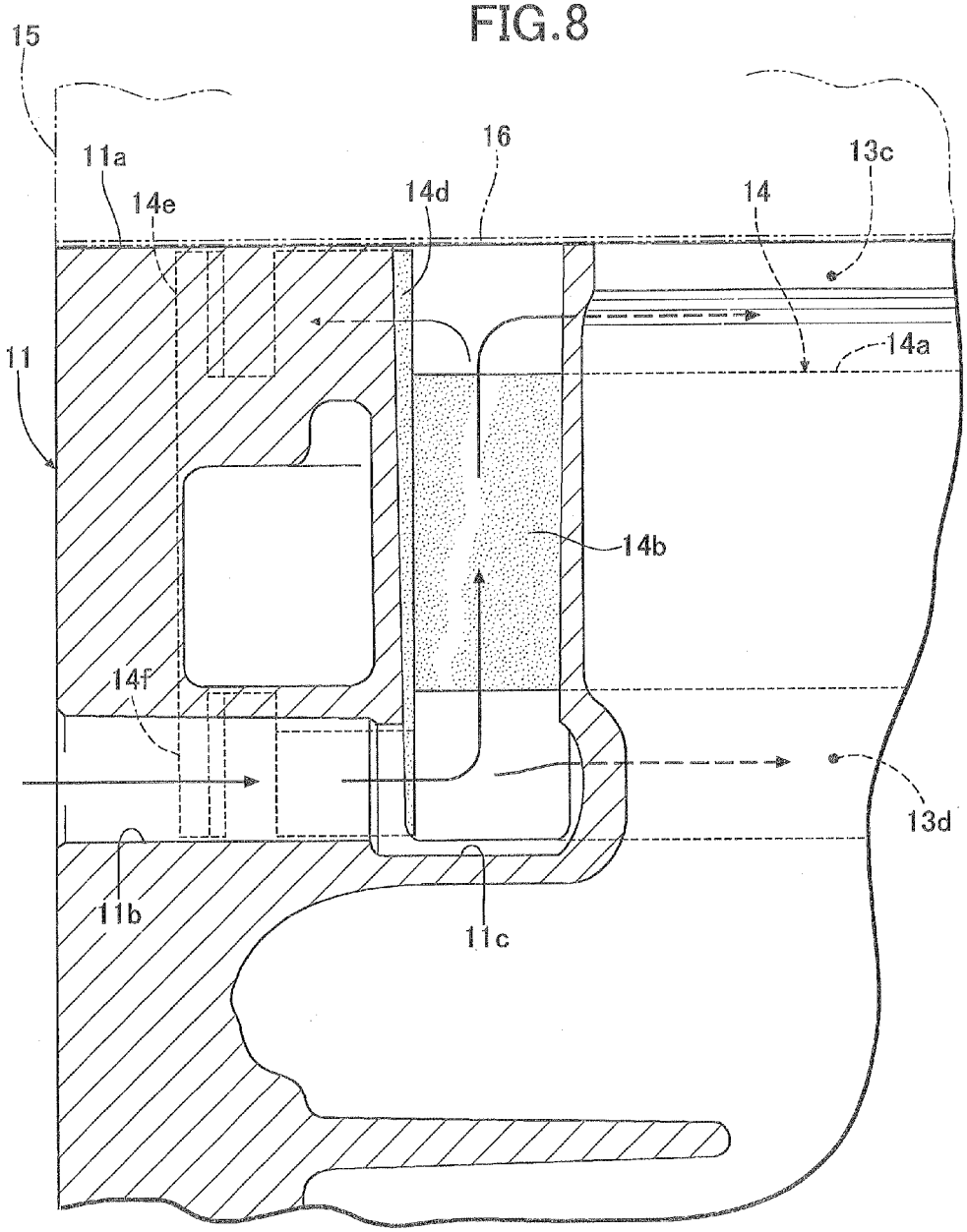
Figure 9:
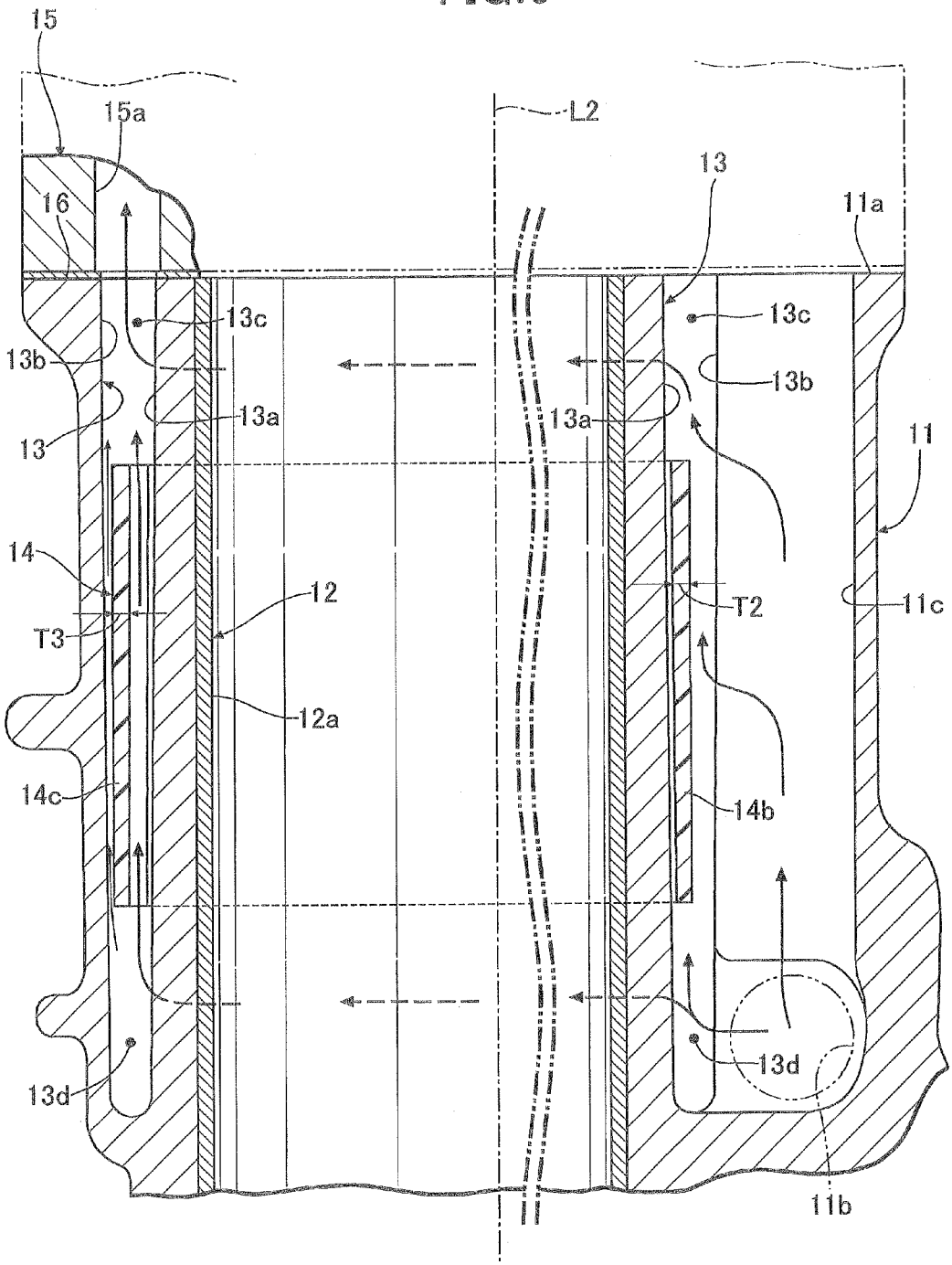
Figure 10:
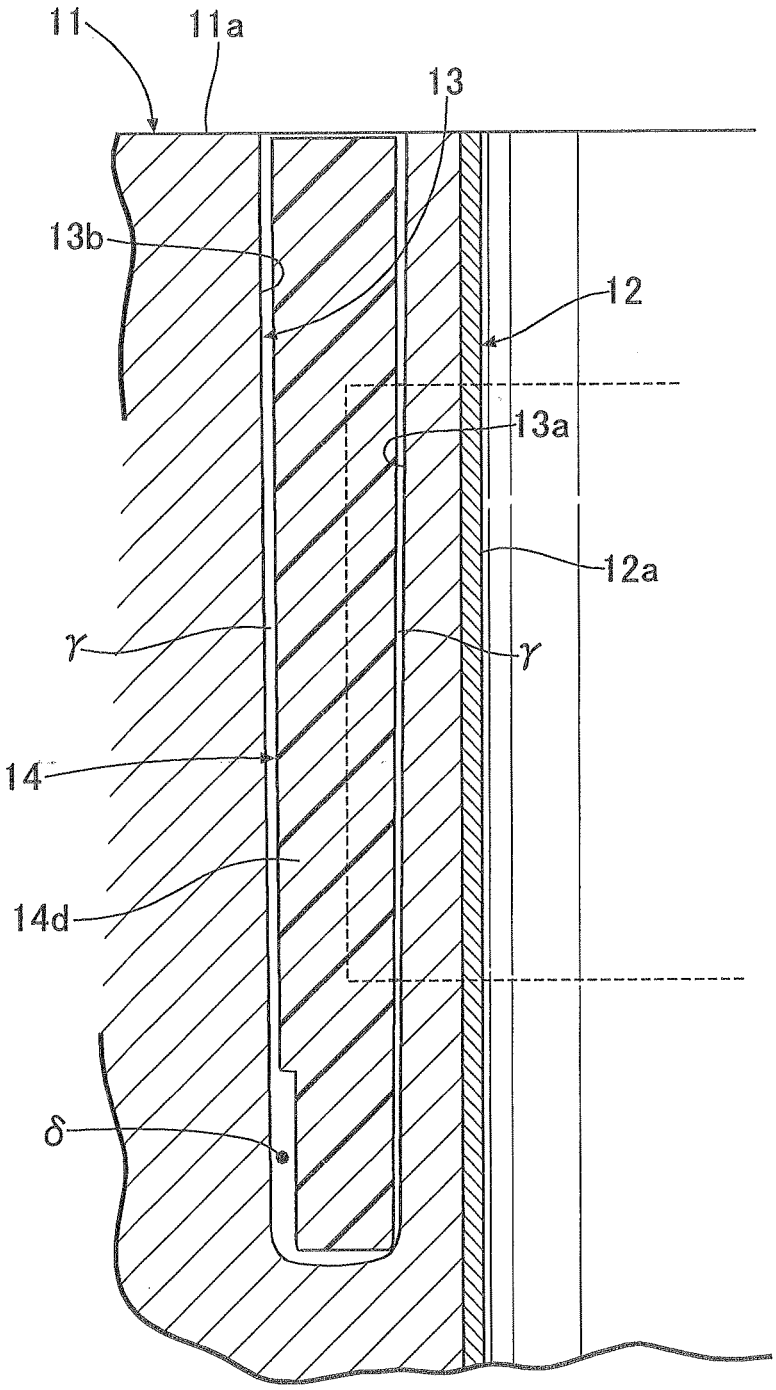
Figure 11B:
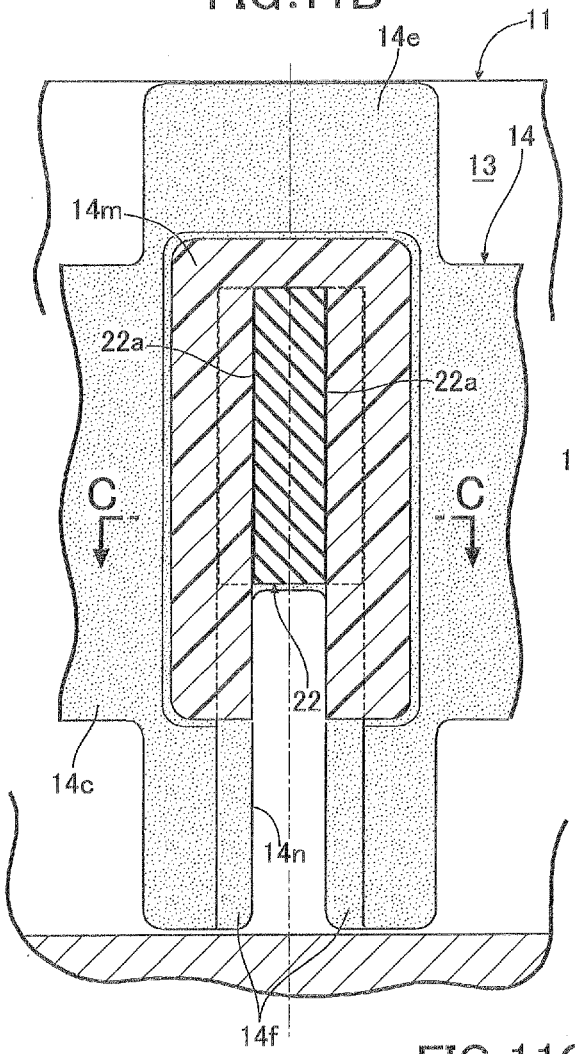
FIG. 11B is a sectional view taken along a line B-B in FIG. 11A.
Figure 11A:
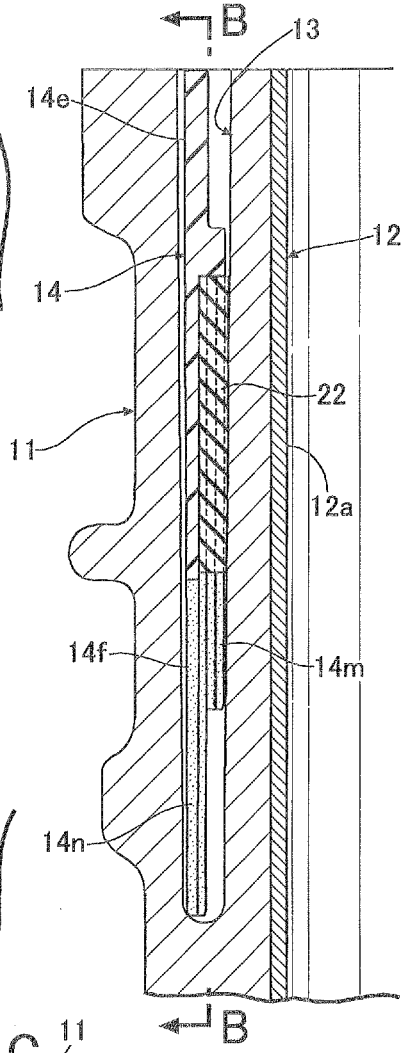
FIG. 11A is a sectional view taken along a line 11-11 in FIG. 3.
Figure 11C:
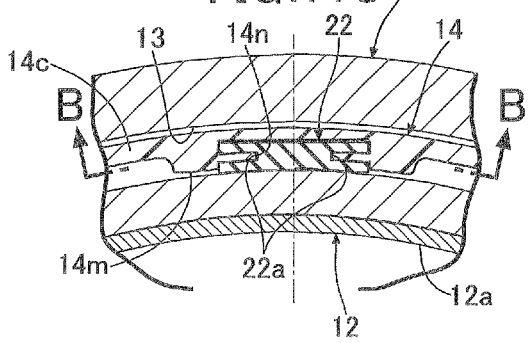
FIG. 11C is a sectional view taken along a line C-C in FIG. 11B.
Figure 12B:
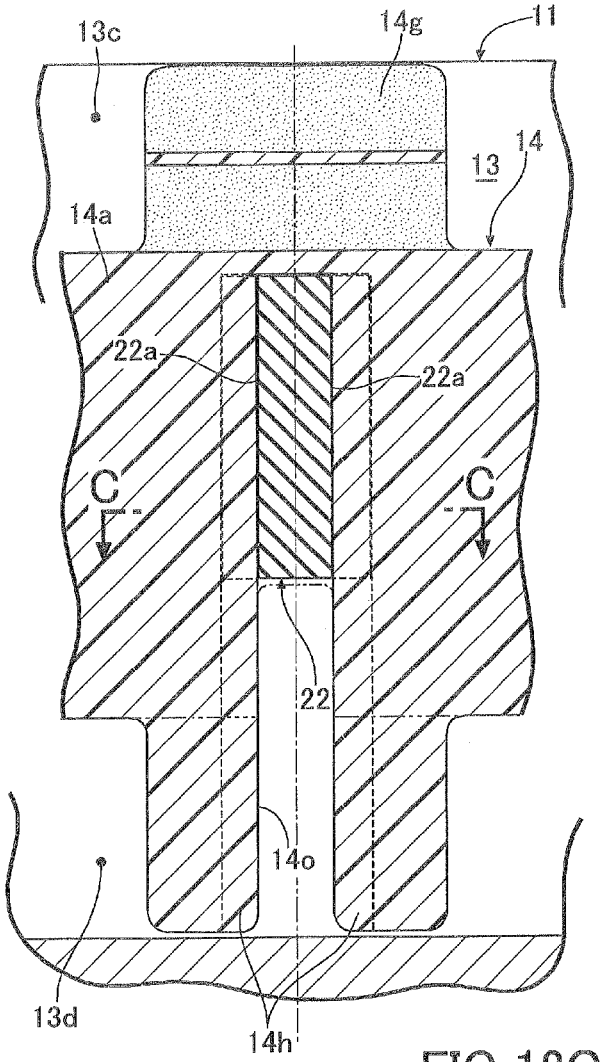
FIG. 12B is a sectional view taken along a line B-B in FIG. 12A.
Figure 12A:
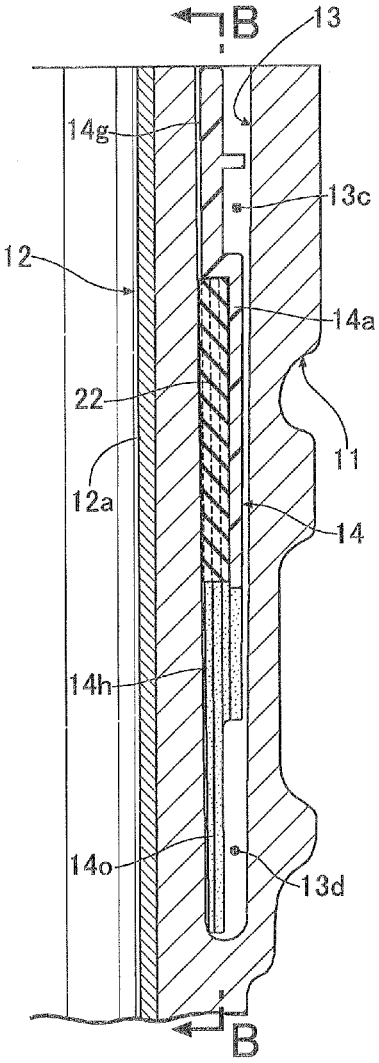
FIG. 12A is a sectional view taken along a line 12-12 in FIG. 3.
Figure 12C:
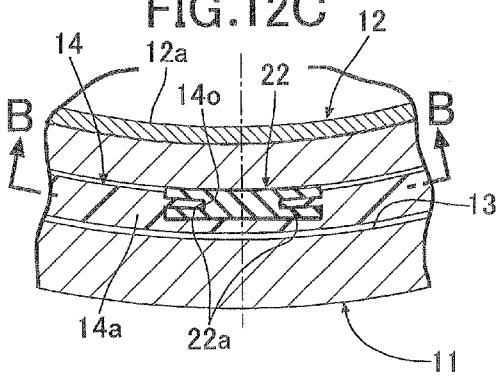

As clear from FIGS. 3 and 7, portions of the water jacket 13 which respectively surround the corresponding two adjacent cylinder sleeves 12, 12 intersect at an acute angle in each inter-bore portion in the cylinder block 11, which is a position at which the corresponding two cylinder sleeves 12, 12 are close to each other. For this reason, a width W' of a portion of the water jacket 13 in a direction orthogonal to the cylinder row line L1 is wider than the width W of any other portion of the water jacket 13. On the other hand, a thickness of a portion of the spacer main body part 14*a* in each inter-bore portion is equal to T1 which is the thickness of any other portion of the spacer main body part 14*a*. For this reason, a space α' between the inner peripheral surface of the spacer main body part 14*a* and the inner wall surface 13*a* of the water jacket 13 in each inter-bore portion is exceptionally larger than the space α therebetween in any other portion.

Nevertheless, in each inter-bore portion in which the corresponding two cylinder sleeves 12, 12 are closer to each other, projection parts 14*i* are formed in an upper end of the spacer main body part 14*a*. A space α" between the tip end portion of each projection part 14*i* and the inner wall surface 13*a* of the water jacket 13 is set smaller than the space α.

As clear from FIGS. 1 to 3, 8 and 9, a cooling water supplying passage 11*b* extends from the timing train-side end surface of the cylinder block 11 toward the transmission. A cooling water supplying chamber 11*c* communicating with a downstream end of this cooling water supplying passage 11*b* faces the cooling water inlet port part 14*b* of the spacer 14 which is accommodated in the water jacket 13.

As clear from FIGS. 1 to 3 and FIG. 9, four communication holes 15*a* which are opened in the undersurface of a water jacket (not illustrated) formed in the cylinder head 15 face the upper portion of the cooling water outlet port part 14*c* of the spacer 14 accommodated in the water jacket 13. If the spacer main body part 14*a* would be extended to the position of the cooling water outlet part 14*c*, the position of the cooling water outlet port part 14*c* would roughly overlap the spacer main body part 14*a* thus extended.

As clear from FIGS. 1 to 3 and FIG. 10, the partition wall 14*d* interposed between the cooling water inlet port part 14*b* and the cooling water outlet port part 14*c* of the spacer 14 has a minimum microspace γ (refer to FIG. 10), which enables the spacer 14 to be assembled, between the inner wall surface 13*a* and the outer wall surface 13*b* of the water jacket 13. A microspace δ through which the cooling water can pass is formed between the lower end portion of the partition wall 14*d* and the outer wall surface 13*b* of the water jacket 13. Like the upper support legs 14*e*, 14*g* and the lower support legs 14*f*, 14*h*, the upper end portion and the lower end portion of the partition wall 14*d* has a function of positioning the spacer 14 inside the water jacket 13 in the up-and-down direction.

As clear from FIG. 2 and FIGS. 11A to 11C, a portion interposed between the upper support leg 14*e* and the lower support leg 14*f* in the timing train-side end portion of the spacer 14 (a portion corresponding to the cooling water outlet port part 14*c*) is a thickness part 14*m* which is as thick as the spacer main body part 14*a*. A slit 14*n* extending in the up-and-down direction is formed ranging from the lower end of the lower support leg 14*f* to the upper end of the thickness part 14*m*. A slit 22*a* of a rubber-made fixing member 22 having an H-shaped horizontal cross section is fitted in and thus attached to the slit 14*n*. The fixing member 22 is attached thereto in a range of the height in the up-and-down-direction of the spacer main body part 14*a*. Although the outer peripheral surface of the fixing member 22 is not exposed to the outer peripheral surface of the spacer 14, the inner peripheral surface of the fixing member 22 is exposed to the inner peripheral surface of the spacer 14, and thus elastically abuts on the inner wall surface 13*a* of the water jacket 13. A portion of the slit 14*n* which is exposed to the lower support leg 14*f* aims at enhancing the assemblability by decreasing the resistance of pressure-insertion of the fixing member 22.

As clear from FIG. 2 and FIGS. 12A to 12C, a slit 14*o* extending in the up-and-down direction from the lower end of the lower support leg 14*h* to the lower end of the upper support leg 14*g* is formed in the transmission-side end portion of the spacer main body part 14*a*. Another rubber-made fixing member 22 having an H-shaped horizontal cross section is attached to the slit 14*o*. The fixing member 22 is attached thereto in a range of the height in the up-and-down-direction of the spacer main body part 14*a*. Although the outer peripheral surface of the fixing member 22 is not exposed to the outer peripheral surface of the spacer 14, the inner peripheral surface of the fixing member 22 is exposed to the inner peripheral surface of the spacer 14, and thus elastically abuts on the inner wall surface 13*a* of the water jacket 13. A portion of the slit 14*o* which is exposed to the lower support leg 14*h* aims at enhancing the assemblability by decreasing the resistance of pressure-insertion of the fixing member 22.

The two fixing members 22, 22 both are arranged on the cylinder row line L1. Accordingly, the intake side portion and the exhaust side portion of the spacer 14 are basically symmetrical with respect to a line joining the two fixing members 22, 22 (in other words, the cylinder row line L1).

The slits 14*n*, 14*o* are opened downward. The fixing members 22, 22 are upward fitted in the slits 14*n*, 14*o*, respectively. For these reasons, when the spacer 14 to which the fixing members 22, 22 are attached is inserted inside the water jacket 13, the fixing members 22, 22 are unlikely to come off the slits 14*n*, 14*o* even if the fixing members 22, 22 are pushed upward by friction forces acting between the fixing members 22, 22 and the inner wall surface 13*a* of the water jacket 13.

Next, descriptions will be provided for the operation of the first embodiment of the present invention having the foregoing configuration.

Before the cylinder head 15 is assembled to the deck surface 11*a* of the cylinder block 11, the water jacket 13 is opened to surround the outer peripheries of the cylinder bores 12*a* of the four cylinder sleeves 12 exposed to the deck surface 11*a*, respectively. The spacer 14 is inserted inside the water jacket 13 from the opening. Thereafter, the cylinder head 15 is fastened to the cylinder block 11 with the gasket 16 overlapping the deck surface 11*a* of the cylinder block 11.

When this spacer 14 is assembled therein, the lower ends of the lower support legs 14*f*, 14*h* and the lower end of a lower protrusion 14*k* of the partition wall 14*d* is in contact with the bottom portion of the water jacket 13, as well as the upper ends of the upper support legs 14*e*, 14*g* and the upper end of an upper protrusion 14*j* of the partition wall 14*d* are in contact with the undersurface of the gasket 16. Thereby, the spacer 14 is positioned in the cylinder axis line L2 direction. At this time, the inner peripheral surface of the spacer main body part 14*a* of the spacer 14 is arranged close to the inner wall surface 13*a* of the water jacket 13. However, because the dimensional precision of the inner wall surface 13*a* of the water jacket 13 which has been subjected no process since casted is not high, the slight space α (refer to FIG. 6) is formed between the inner peripheral surface of the spacer main body part 14*a* and the inner wall surface 13*a* of the water jacket 13 for the purpose of preventing the assemblability from deteriorating due to friction of the spacer 14 with the inner wall surface 13*a* of the water jacket 13.

If the spacer 14 moves in the up-and-down direction inside the water jacket 13 due to vibrations and the like during the operation of the internal combustion engine, there is a possibility that the upper ends of the upper support legs 14*e*, 14*g* and the upper end of the upper protrusion 14*j* of the partition wall 14*d* may damage the undersurface of the gasket 16. However, the two fixing members 22, 22 provided on the respective opposite ends in the cylinder row line L1 direction fix the spacer 14 to the water jacket 13 in order that the spacer 14 cannot move relative to the water jacket 13. This prevents haphazard movement of the spacer 14 from damaging the gasket 16.

At this time, not only can the spacer 14 be firmly fixed to the inside of the water jacket 13 because the fixing member 22, 22 are provided in the respective two highly-rigid end portions of the spacer 14 in the cylinder row line L1 direction, but also the influence of heat on the rubber-made fixing members 22, 22 attached to the respective opposite end portions of the cylinder block 11 in the cylinder row line L1 direction can be suppressed to a minimum because the opposite end portions of the cylinder block 11 are lower in temperature than the intake-side and exhaust-side side surfaces of the cylinder block 11.

In addition, because the fixing members 22, 22 are provided in the respective intermediate portions of the spacer 14 in the cylinder axis line L2 direction,in other words, in the range of the height of the spacer main body part 14*a*, it is possible to prevent the blockage of the flow of the cooling water in the upper cooling water passage 13*c* and in the lower cooling water passage 13*d* by the fixing members 22, 22, which would otherwise occur. In addition, because the timing train-side fixing member 22 of the spacer 14 is provided in the cooling water outlet port part 14*c*, the fixing member 22 does not affect the flow of the cooling water in the upper cooling water passage 13*c* and in the lower cooling water passage 13*d*. Furthermore, the flow speed of the cooling water decreases due to the U-turn of the cooling water in the transmission-side end portion of the water jacket 13. Accordingly, the influence of the fixing member 22 on the flow of the cooling water can be made smaller when the fixing member 22 is provided in the transmission-side end portion of the water jacket 13 than when the fixing member 22 is provided in the intake-side and exhaust-side side wall of the water jacket 13.

The timing train-side upper support leg 14*e* and lower support leg 14*f* of the spacer 14 are formed thinner in the radial direction than the thickness T1 of the spacer main body part 14*a*, and are arranged offset toward the outer wall surface 13*b* of the water jacket 13 inside the upper cooling water passage 13*c* and the lower cooling water passage 13*d*. In addition, the transmission-side upper support leg 14*g* and the lower support leg 14*h* of the spacer 14 are formed thinner in the radial direction than the thickness T1 of the spacer main body part 14*a*, and are arranged offset toward the inner wall surface 13*a* of the water jacket 13 inside the upper cooling water passage 13*c* and the lower cooling water passage 13*d*. Thereby, the influence of the upper support legs 14*e*, 14*g* and the lower support legs 14*f*, 14*h* on the flow of the cooling water in the upper cooling water passage 13*c* and in the lower cooling water passage 13*d* can be suppressed to a minimum. In addition, the upper support legs 14*e*, 14*g* and the lower support legs 14*f*, 14*h* are curved in the shape of an arc along the forms of the inner wall surface 13*a* and the outer wall surface 13*b* of the water jacket 13. Accordingly, the influence on the flow of the cooling water can be made much smaller.

Furthermore, out of the four cylinder bores 12*a*, their portions situated outermost in the cylinder row line L1 direction are less susceptible to heat from the other cylinder bores 12*a*. For this reason, the temperature of such portions is relatively low. On the other hand, out of the four cylinder bores 12*a*, portions situated on the intake side and exhaust side with respect to the cylinder row line L1 are susceptible to heat from their adjacent cylinder bores 12*a*. For this reason, the temperature of such portions is relatively high. In the present embodiment, the upper support legs 14*e*, 14*g* and the lower support legs 14*f*, 14*h* are provided in the outermost positions in the cylinder row line L1 direction in which the temperature of the cylinder bores 12*a* is relatively low. For this reason, even if the flow of the cooling water in the water jacket 13 is more or less blocked by the upper support legs 14*e*, 14*g* and the lower support legs 14*f*, 14*h*, the influence can be suppressed to a minimum, and the temperatures of the respective cylinder bores 12*a* can be made uniform.

In particular, the transmission-side upper support leg 14*g* and lower support leg 14*h* are arranged along the inner wall surface 13*a* of the water jacket 13 which faces the transmission-side lower-temperature portion of the corresponding cylinder bore 12*a*. For this reason, it is possible to make the cooling water less likely to come into contact with the inner wall surface 13*a* of the water jacket 13 by use of the upper support leg 14*g* and the lower support leg 14*h*, and to thermally insulate the cylinder bore 12*a*, whose temperature is relatively low. This makes it possible to make the temperatures of the respective cylinder bores 12*a* much more uniform.

The fixing members 22, 22 are made of the rubber, as well as are fitted in and fixed to the slits 14*n*, 14*o* of the spacer 14. For this reason, the fixing members 22, 22 can be fixed to the spacer 14 without any specialized members, such as bolts. In addition, the positions at which the fixing members 22, 22 are provided are immediately above the lower support legs 14*f*, 14*h*. For this reason, it is possible to prevent the spacer 14 from deforming in a twisted manner when: the spacer 14 is downward pushed into the inside of the water jacket 13 while putting the fixing members 22, 22 in pressure contact with the inner wall surface 13*a* of the water jacket 13; the lower ends of the lower support legs 14*f*, 14*h* subsequently come in contact with the bottom portion of the water jacket 13; and the spacer 14 receives an upward force.

During the operation of the internal combustion engine, the cooling water supplied from a water pump (not illustrated) provided to the cylinder block 11 flows into the water jacket 13 from the cooling water supplying passage 11*b*, which is provided in the timing train-side end portion of the cylinder block 11, through the cooling water supplying chamber 11*c*. The spacer 14 is arranged inside the water jacket 13. The thickness T2 of the cooling water inlet port part 14*b* of the spacer 14, which faces the cooling water supplying chamber 11*c*, is thinner than the thickness T1 of the spacer main body part 14*a*. In addition, the cooling water inlet port part 14*b* is offset inward in the radial direction. For these reasons, the flow of the cooling water bifurcates into upper and lower streams along the radial-direction outer surface of the cooling water inlet port part 14*b*, and the cooling water thus smoothly flows into the upper cooling water passage 13*c* and the lower cooling water passage 13*d* of the water jacket 13.

The cooling water having flown into the upper cooling water passage 13*c* and the lower cooling water passage 13*d* of the water jacket 13 tends to bifurcate in the left and right directions. However, the flow of the cooling water is once blocked by the partition wall 14*d* existing on the left of the cooling water inlet port part 14*b*. For this reason, the direction of the flow of the cooling water is turned to the right. Subsequently, the cooling water flows counterclockwise in the upper cooling water passage 13*c* and the lower cooling water passage 13*d* in almost full length. Finally, the cooling water is discharged to the communication holes 15*a* in the cylinder head 15 from the cooling water outlet port part 14*c* which is situated on the opposite side of the partition wall 14*d* from the cooling water inlet port part 14*b*. While the cooling water is flowing in the water jacket 13, the cooling water flowing in the upper cooling water passage 13*c* and the cooling water flowing in the lower cooling water passage 13*d* hardly ever mingle with each other, because the upper cooling water passage 13*c* and the lower cooling water passage 13*d* are partitioned vertically by the spacer main body part 14*a* whose thickness T1 is slightly thinner than the width W of the water jacket 13.

When the cooling water having flown in the water jacket 13 is discharged to the water jacket (not illustrated) in the cylinder head 15 through the communication holes 15*a* opened to the undersurface of the cylinder head 15, the cooling water having flown in the lower cooling water passage 13*d* passes the cooling water outlet port part 14*c* of the spacer 14 from its lower part to its upper part, and thus joins the cooling water having flown in the upper cooling water passage 13*c*. Thereafter, the confluent cooling water flows into the communication holes 15*a* in the cylinder head 15.

At this time, not only can loss of the pressure of the cooling water upward passing the cooling water outlet port part 14*c* be suppressed to a minimum, but also the cooling effect can be secured even in a vicinity of the cooling water outlet port part 14*c*, in which the cooling effect decreases due to reduction in the flow rate of the cooling water, by causing as much cooling water as possible to intervene between the cooling water outlet port part 14*c* and the inner wall surface 13*a* of the water jacket 13. That is because: the cooling water outlet port part 14*c* is offset toward the outer wall surface 13*b* of the water jacket 13 with the thickness T3 of the cooling water outlet port part 14*c* being less than the thickness T1 of the spacer main body part 14*a* and with the outer peripheral surface being flush with the outer peripheral surface of the spacer main body part 14*a*.

In addition, the cooling water having come out of the downstream end of the upper cooling water passage 13*c* joins the cooling water having changed its flow direction upward after coming out of the downstream end of the lower cooling water passage 13*d*. Accordingly, the direction of the cooling water having come from the upper cooling water passage 13*c* can be changed upward by the cooling water having coming from the lower cooling water passage 13*d*, and the cooling water having come from the upper cooling water passage 13*c* can be made to flow into the communication holes 15*a* smoothly.

When the cooling water having flown in the upper cooling water passage 13*c* and the lower cooling water passage 13*d* is discharged from the communication holes 15*a* after changing its direction upward at the cooling water outlet port part 14*c*, there is a possibility that: swirls of the cooling water may occur; and the smooth direction change may be hindered. However, the flow of the cooling water into the communication holes 15*a* can be achieved by preventing the occurrence of the swirls, because a portion of the cooling water in the cooling water inlet port part 14*b* flows into the cooling water outlet port part 14*c* after passing the space δ (refer to FIG. 10) in the lower end portion of the partition wall 14*d*.

The inner peripheral surface of the spacer main body part 14*a* of the spacer 14 is close to the inner wall surface 13*a* at the intermediate portion of the water jacket 13 in the cylinder axis lines L2 direction. Accordingly, only a less amount of the cooling water comes into contact with the inner wall surface 13*a*, and the cooling is suppressed. As a result, the intermediate portions of the cylinder bores 12*a* in the cylinder axis lines L2 direction, which are opposed to the spacer main body part 14*a*, become higher in temperature than the other portions thereof, and thermally expand to have larger clearances between the cylinder bores 12*a* and their corresponding pistons 18. As a consequence, frictions between the pistons 18 and the cylinder bores 12*a* are reduced, particularly when large side thrusts are applied to the respective pistons 18 during the compression process and the expansion process. Accordingly, it is possible to contribute to improving fuel efficiency of the internal combustion engine. Furthermore, because the intermediate portions of the cylinder bores 12*a* in the cylinder axis lines L2 direction become higher in temperature than any other portions thereof, the temperature of the oil lubricating such portions rises, and the viscosity of the oil decreases. For this reason, the effect of friction reduction is enhanced more.

On the other hand, the upper portions and lower portions of the cylinder bores 12*a* in the cylinder axis lines L2 direction are sufficiently cooled by the cooling water flowing in the upper cooling water passage 13*c* and the lower cooling water passage 13*d* above and under the spacer 14. Accordingly, it is possible to secure the cooling performances of the top parts 18*a* and the skirt parts 18*b* of the pistons 18 slidably fitted in the cylinder bores 12*a* and to prevent their overheat, although the temperatures of the top parts 18*a* and the skirt parts 18*b* would otherwise tend to rise. Moreover, not only does the upper portions of the cylinder bores 12*a* directly receive heat of a combustion chamber, but also the upper portions thereof tend to raise their temperatures due to their reception of heat transmitted through the top rings 19, the second rings 20 and the oil rings 21 from the heated pistons 18 which stay at the vicinities of their top dead centers for long time due to the change in their movement directions. However, because no spacer 14 is made to face the upper portions of the cylinder bores 12*a*, their cooling performances can be secured. In addition, the skirt parts 18*b* of the pistons 18 are places which are most tightly put in sliding contact with the cylinder bores 12*a*, thereby causing friction therebetween. However, because the cylinder bores 12*a* with which the skirt parts 18*b* are put in sliding contact are covered with the spacer 14 and the diameters of the cylinder bores 12*a* is increased by thermal expansion, the friction can be reduced.

As indicated by the continuous line in FIG. 5, the up-and-down position of the spacer 14 is set in such a way that the top rings 19, the second rings 20 and the oil rings 21 are situated above the upper edge of the spacer main body part 14*a*, when the side thrusts of the respective pistons 18 reach their maximum during the expansion process, in other words, when the friction between the pistons 18 and the cylinder bores 12*a* reaches its maximum. For this reason, the cooling performance of the pistons 18 can be secured by: reducing the friction by increasing the inner diameters of the cylinder bores 12*a* by use of the spacer 14; and concurrently making the heat of the top parts 18*a* of the heated pistons 18 whose temperature tend to be higher, escape to the upper cooling water passage 13*c* of the water jacket 13 from the highly heat-conductive top rings 19, second rings 20 and oil rings 21 through the cylinder bores 12*a*.

At this time, because the spacer main body part 14*a* of the spacer 14 is close to the inner wall surface 13*a* of the water jacket 13 with the minimum space α being interposed in between, it is possible to suppress the amount of cooling water intervening between the spacer main body part 14*a* and the inner wall surface 13*a* of the water jacket 13 to a minimum, and thus to thermally insulate the up-and-down-direction intermediate portions of the cylinder bores 12*a* effectively, as well as to enlarge the diameters of the cylinder bores 12*a*.

In addition, at the bottom dead centers indicated by the chain line in FIG. 5, the quantity of heat transmitted to the cylinder bores 12*a* from the pistons 18 through the top rings 19, the second rings 20 and the oil rings 21 is larger because the speeds at which the pistons 18 move decrease. However, when the pistons 18 reaches their bottom dead centers, the top rings 19, the second rings 20 and the oil rings 21 are situated below the lower edge of the spacer main body part 14*a*. For this reason, it is possible to make the heat of the pistons 18 escape to the cylinder bores 12*a* without being obstructed by the spacer 14, and to secure the cooling performances of the pistons 18.

Moreover, when the spacer 14 is assembled inside the water jacket 13, the space α between the inner peripheral surface of the spacer main body part 14*a* and the inner wall surface 13*a* of the water jacket 13 is set smaller than the space β between the outer peripheral surface of the spacer main body part 14*a* and the outer wall surface 13*b* of the water jacket 13. For this reason, the outer peripheral surface of the spacer main body part 14*a* is designed not to come in contact with the outer wall surface 13*b* of the water jacket 13, even though: the spacer 14 may deviate in the radial direction due to the assembling error and its deformation; and the inner peripheral surface of the spacer main body part 14*a* may come into contact with the inner wall surface 13*a* of the water jacket 13.

Because, as described above, the space is always secured between the outer peripheral surface of the spacer main body part 14*a* and the outer wall surface 13*b* of the water jacket 13, the following operation/working effects are exerted. To put it specifically, if unlike the present embodiment, the outer peripheral surface of the spacer main body part 14*a* would come in contact with the outer wall surface 13*b* of the water jacket 13, the hitting sounds of the pistons 18 would be propagated via pathways from the cylinder bores 12*a*, the bottom portion of the water jacket 13, the lower support legs 14*f*, 14*h* of the spacer 14, the spacer main body part 14*a* to the outer wall surface 13*b* of the water jacket 13, and accordingly would constitute the cause of noises, because the lower support legs 14*f*, 14*h* of the spacer 14 are in contact with the bottom portion of the water jacket 13. Meanwhile, in the present embodiment, although hitting sounds of the pistons 18 are propagated from the cylinder bores 12*a* to the spacer main body part 14*a*, the hitting sounds are blocked in the spacer main body part 14*a* because the spacer main body part 14*a* does not abut on the outer wall surface 13*b* of the water jacket 13, thereby reducing noises.

If the spacer 14 deforms due to its swelling resulting from its contact with the cooling water and its thermal expansion, there is a possibility that the inner peripheral surface of the spacer 14 may be tightly fitted to the inner wall surface 13*a* of the water jacket 13. However, because the projection parts 14*i* provided on the spacer main body part 14*a* are opposed to the inner wall surface 13*a* of the water jacket 13 to come in contact with the inner wall surface 13*a* thereof, it is possible to prevent the inner peripheral surface of the spacer main body part 14*a* and the inner wall surface 13*a* of the water jacket 13 from coming into intimate contact with each other throughout their surfaces. Note that if the projection parts 14*i* come in contact with the inner wall surface 13*a* of the water jacket 13, there is a possibility that the hitting sounds may be propagated through the projection parts 14*i*. Basically, however, hitting sounds largely occur in the intake-side and exhaust-side portions of the outer peripheral surface of the pistons 18 which are distant from the cylinder row line L1, and hitting sounds hardly ever occur in portions close to the cylinder row line L1 in which the projection parts 14*i* are provided. For this reason, the propagation of hitting sounds through the projection parts 14*i* substantially does not matter.

Figure 2:
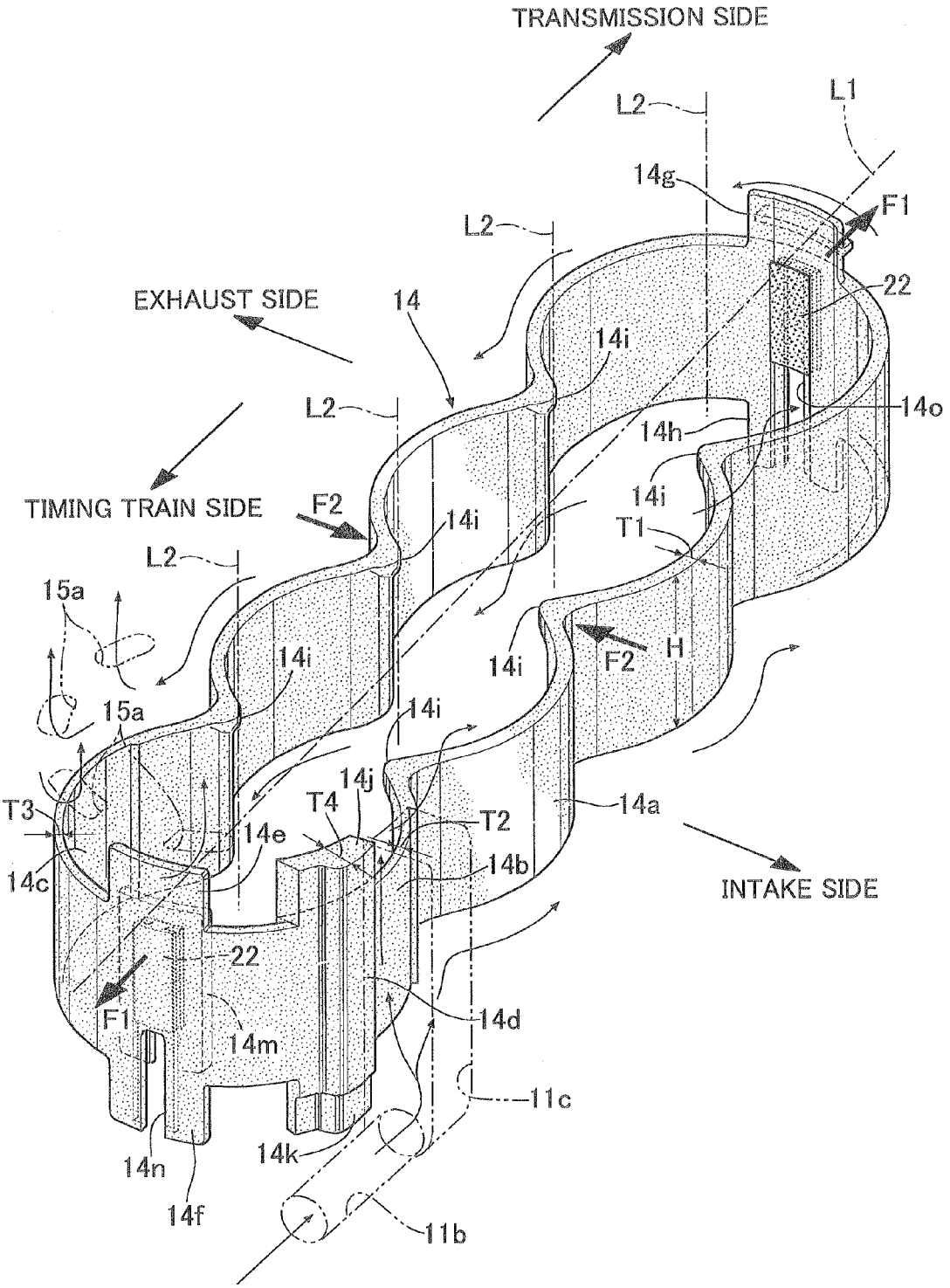

In addition, as shown in FIG. 2, the spacer 14 is stretched in the cylinder row line L1 direction by the reaction forces F1, F1, because the fixing members 22, 22 provided in the respective opposite end portions of the spacer 14 in the cylinder row line L1 direction elastically contact the inner wall surface 13*a* of the water jacket 13. As a result, the intake-side and exhaust-side side surfaces of the spacer main body part 14*a* deform by receiving loads F2, F2 working in a direction in which the intake-side and exhaust-side side surfaces thereof come closer to each other. For this reason, the inner peripheral surface of the spacer main body part 14*a* comes closer to the inner wall surface 13*a* of the water jacket 13, and the space α between the inner peripheral surface of the spacer main body part 14*a* and the inner wall surface 13*a* of the water jacket 13 decreases accordingly. Thereby, the amount of cooling water intervening between the spacer main body part 14*a* and the inner wall surface 13*a* of the water jacket 13 can be reduced more, and the up-and-down-direction intermediate portions of the cylinder bores 12*a* thus can be thermally insulated more effectively, as well as the diameters thereof can be enlarged.

At this time, the two fixing members 22, 22 both are arranged on the cylinder row line L1, and the intake-side portion and exhaust-side portion of the spacer 14 are basically symmetrical with respect to the cylinder row line L1. For this reason, the loads F2, F2 which cause the intake-side and exhaust-side side surfaces of the spacer main body part 14*a* to come closer to each other can be made uniform, and the amount of deformation of the intake-side portion of the spacer 14 and the amount of deformation of the exhaust-side portion of the spacer 14 can be made uniform.

Furthermore, because the fixing members 22, 22 are attached to the spacer main body part 14*a* in a way not to cut into the upper cooling water passage 13*c* or the lower cooling water passage 13*d*, the fixing members 22, 22 do not obstruct the flow of the cooling water. In addition, because the fixing member 22, 22 are attached to the spacer main body part 14*a* in a way not to interfere with the upper support legs 14*e*, 14*g* or the lower support legs 14*f*, 14*h* of the spacer 14, the spacer main body part 14*a* can be efficiently deformed with the resilient forces of the fixing members 22, 22.

Next, descriptions will be provided for a second embodiment of the present invention on the basis of FIGS. 13 to 23B.

Note that: reference signs used for the second and third embodiments are independent of the reference signs used for the first embodiment; and the same reference signs do not necessarily denote the same members.

Figure 13:
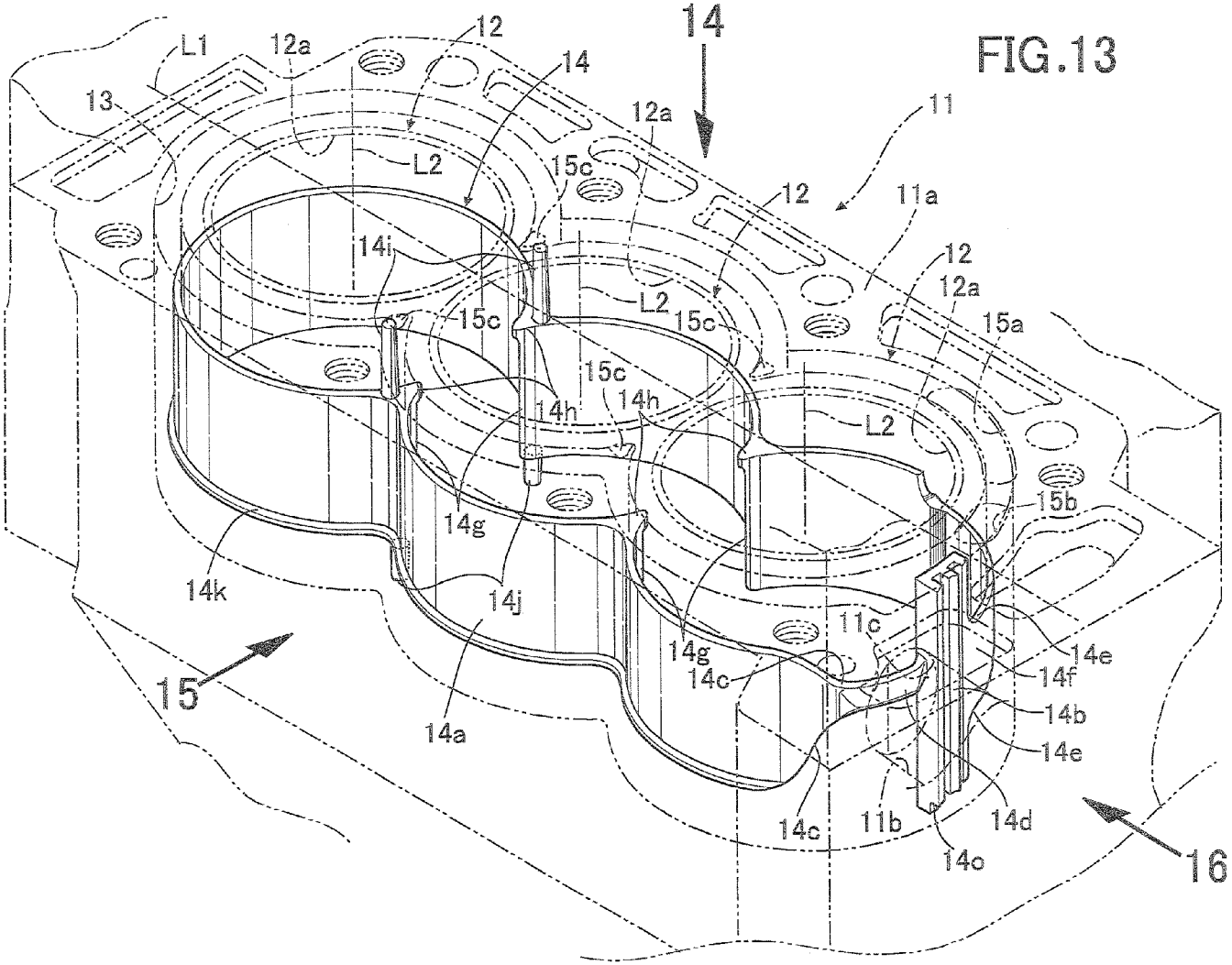

FIG. 13 shows one bank of a cylinder block 11 of a V-type internal combustion engine with six cylinders. Three cylinder sleeves 12 are embedded in the cylinder block 11 along a cylinder row line L1. A water jacket 13 is formed to surround the outer peripheral surfaces of the respective cylinder sleeves 12. The cylinder block 11 according to this embodiment is of a Siamese type, and no portion of the water jacket 13 is formed between the neighboring cylinder sleeves 12. Accordingly, the water jacket 13 surrounds the three cylinder sleeves 12 as a whole, instead of surrounding the outer peripheral surfaces of the respective three cylinder sleeves 12 individually. Thereby, the shortening of the dimension of the internal combustion engine in the cylinder row line L1 direction is achieved. The water jacket 13 opened in a deck surface 11*a* of the cylinder block 11 extends downward from the deck surface 11*a* toward a crankcase up to a certain depth. A spacer 14 made of a synthetic resin is arranged inside the water jacket 13. The spacer 14 is inserted therein from the opening in the deck surface 11*a* of the cylinder block 11.

Note that with regard to an "up-and-down direction" in this description, the cylinder head side in a cylinder axis line L2 direction is defined as "upper," and the crankcase side in the cylinder axis line L2 direction is defined as "lower."

As clear from FIGS. 13 to 16, the spacer 14 includes: a spacer main body part 14*a* surrounding most of the outer peripheries of the respective three cylinder sleeves 12 in the cylinder block 11; and a cooling water inlet port part 14*d* and a cooling water outlet port part 14*f* surrounding the rest of the outer peripheries thereof. The spacer 14 is formed in a shape closed along the water jacket 13, and has no cut portion. For this reason, the rigidity of the spacer 14 is higher. The height H0 of the spacer main body part 14*a* in the cylinder axis line L2 direction is basically uniform throughout its periphery. A partition wall 14*b* projecting upward and downward between the cooling water inlet port part 14*d* and the cooling water outlet port part 14*f* is integrally provided in one end side of the spacer 14 in the cylinder row line L1 direction, namely a timing train-side end portion of the cylinder block 11.

In addition, the cooling water inlet port part 14*d* is formed in a portion adjacent to one side (intake-side) portion of the partition wall 14*b* to be vertically interposed between inlet port cutouts 14*c*, 14*c* which are respectively provided to the upper edge and lower edge of the spacer 14. The height H1 of the spacer 14 in the cylinder axis line L2 direction in this cooling water inlet port part 14*d* is smaller than the height H0 of the spacer main body part 14*a*. Similarly, the cooling water outlet port part 14*f* is formed in a portion adjacent to the other side (exhaust-side) portion of the partition wall 14*b* to be vertically interposed between outlet port cutouts 14*e*, 14*e* which are respectively provided to the upper edge and lower edge of the spacer 14. The height H2 of the spacer 14 in the cylinder axis line L2 direction at a portion corresponding to this cooling water outlet port part 14*f* is smaller than the height H0 of the spacer main body part 14*a*. The upper and lower inlet port cutouts 14*e*, 14*e* of the cooling water inlet port part 14*d* respectively continue to the upper edge and lower edge of the spacer main body part 14*a* while smoothly curving.

Figure 14:
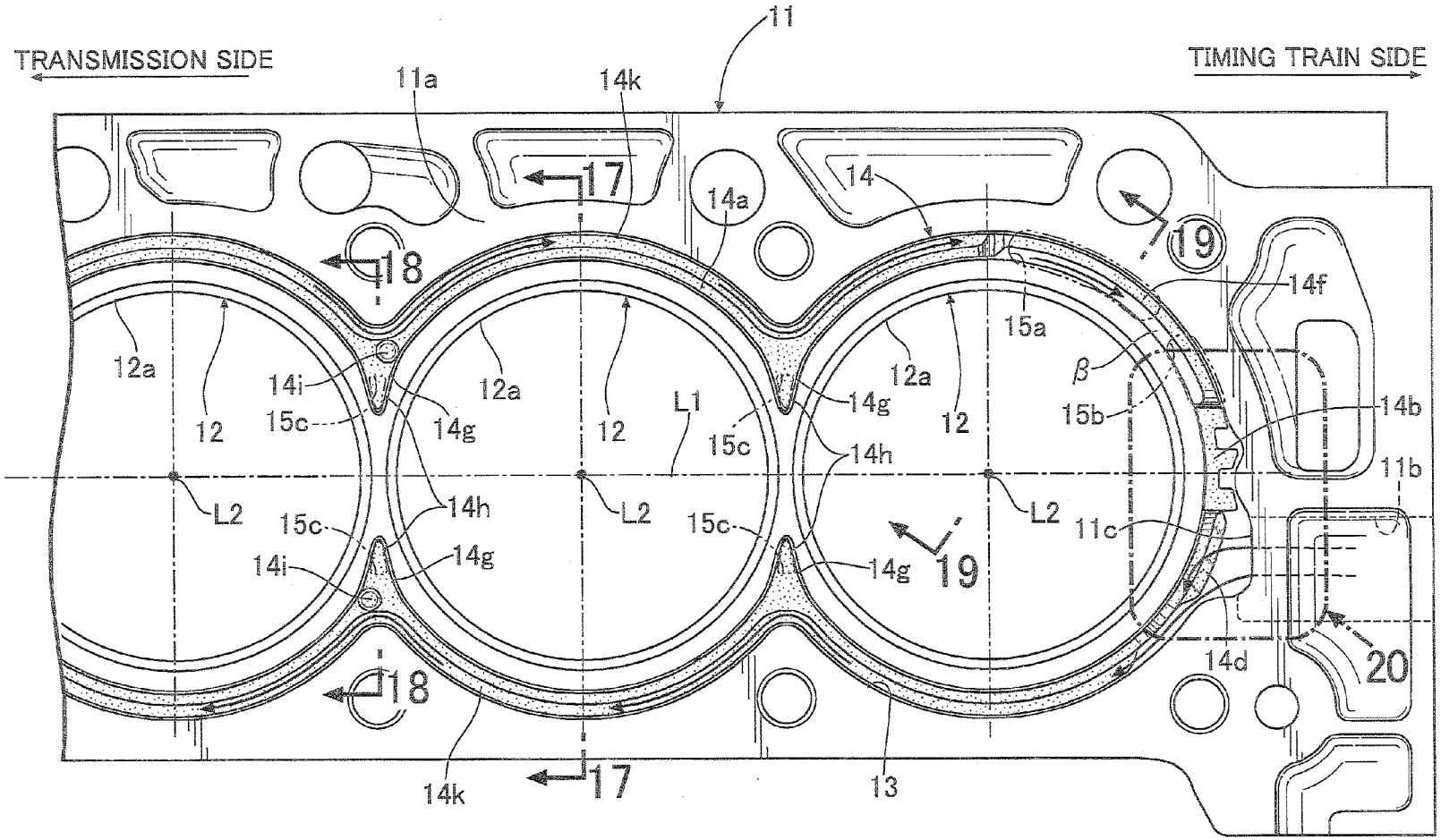
Figure 15:
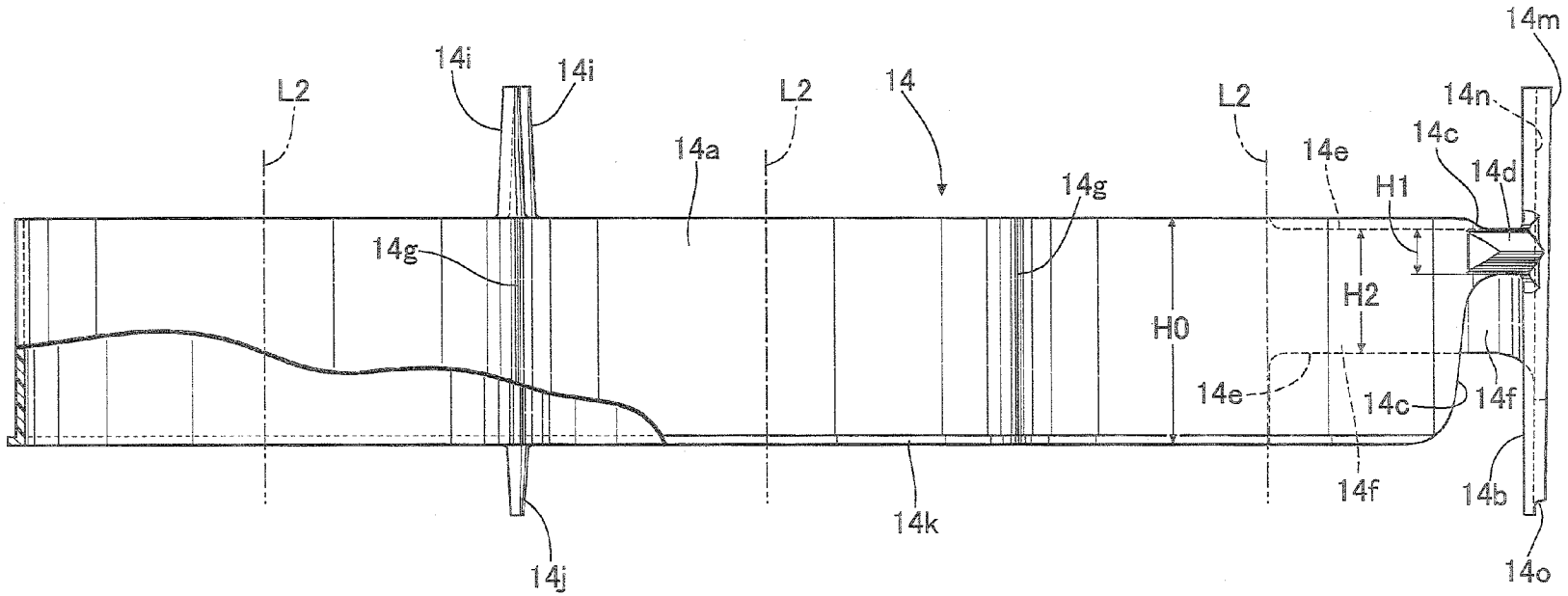
Figure 16:
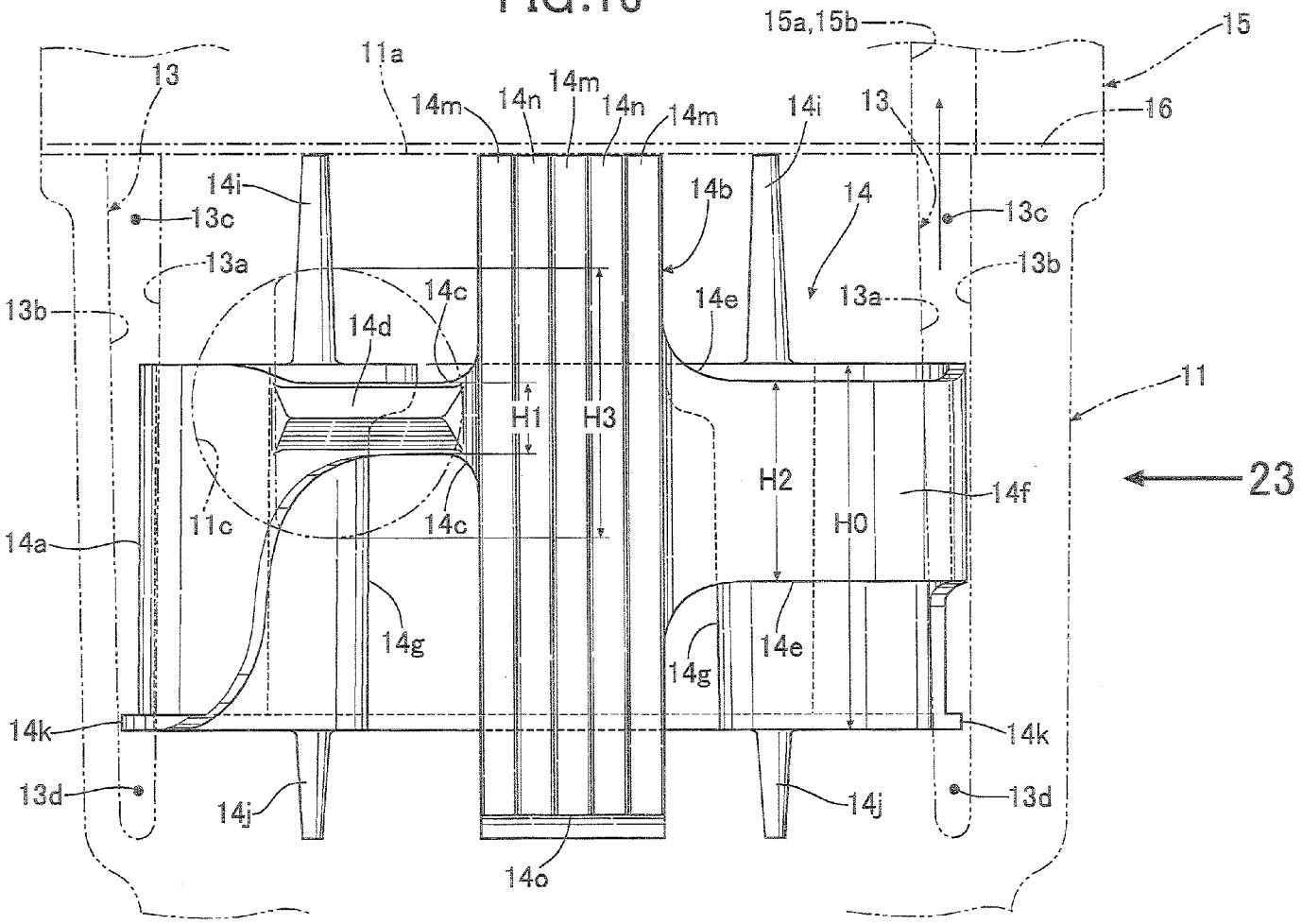
Figure 17:
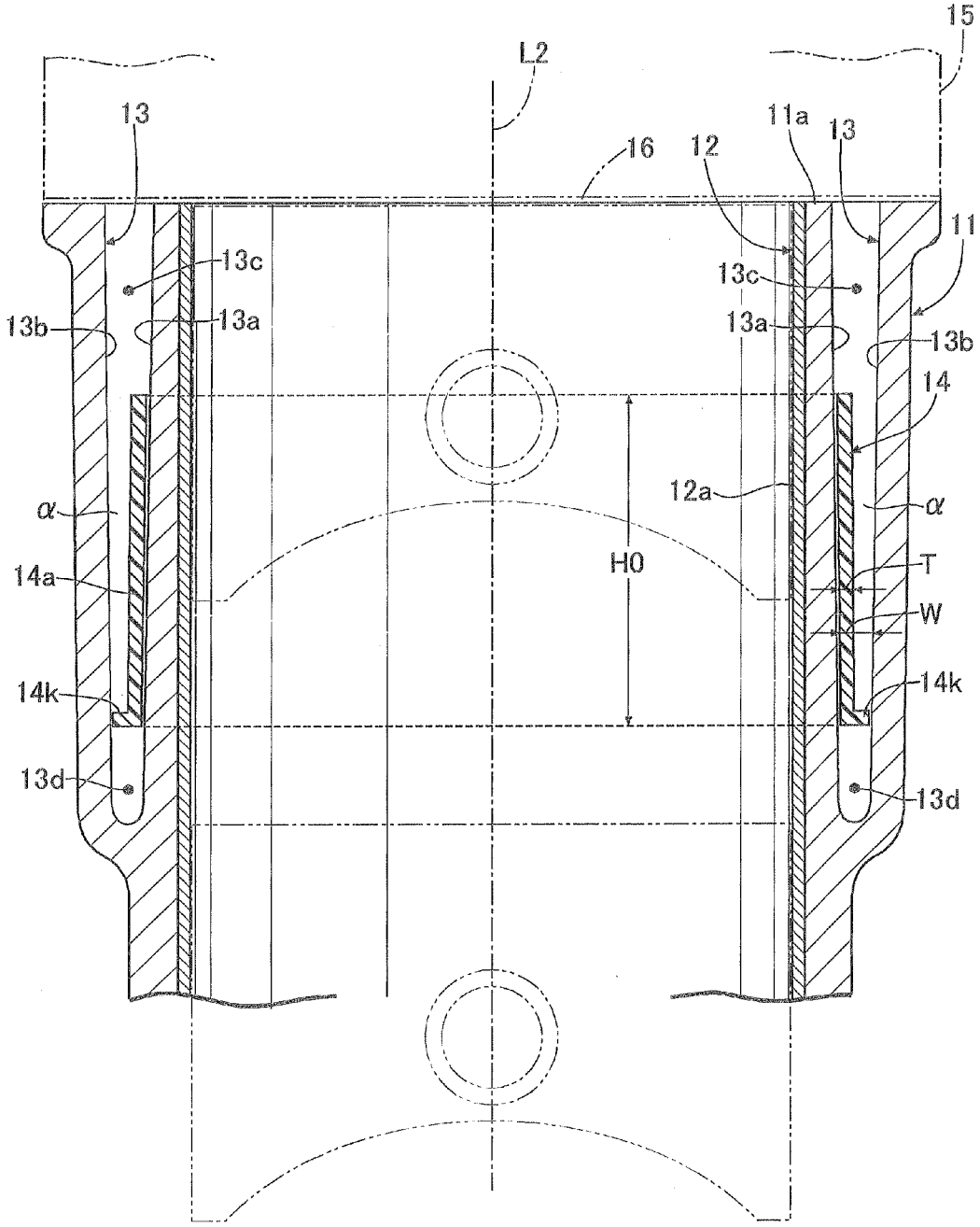
Figure 18:
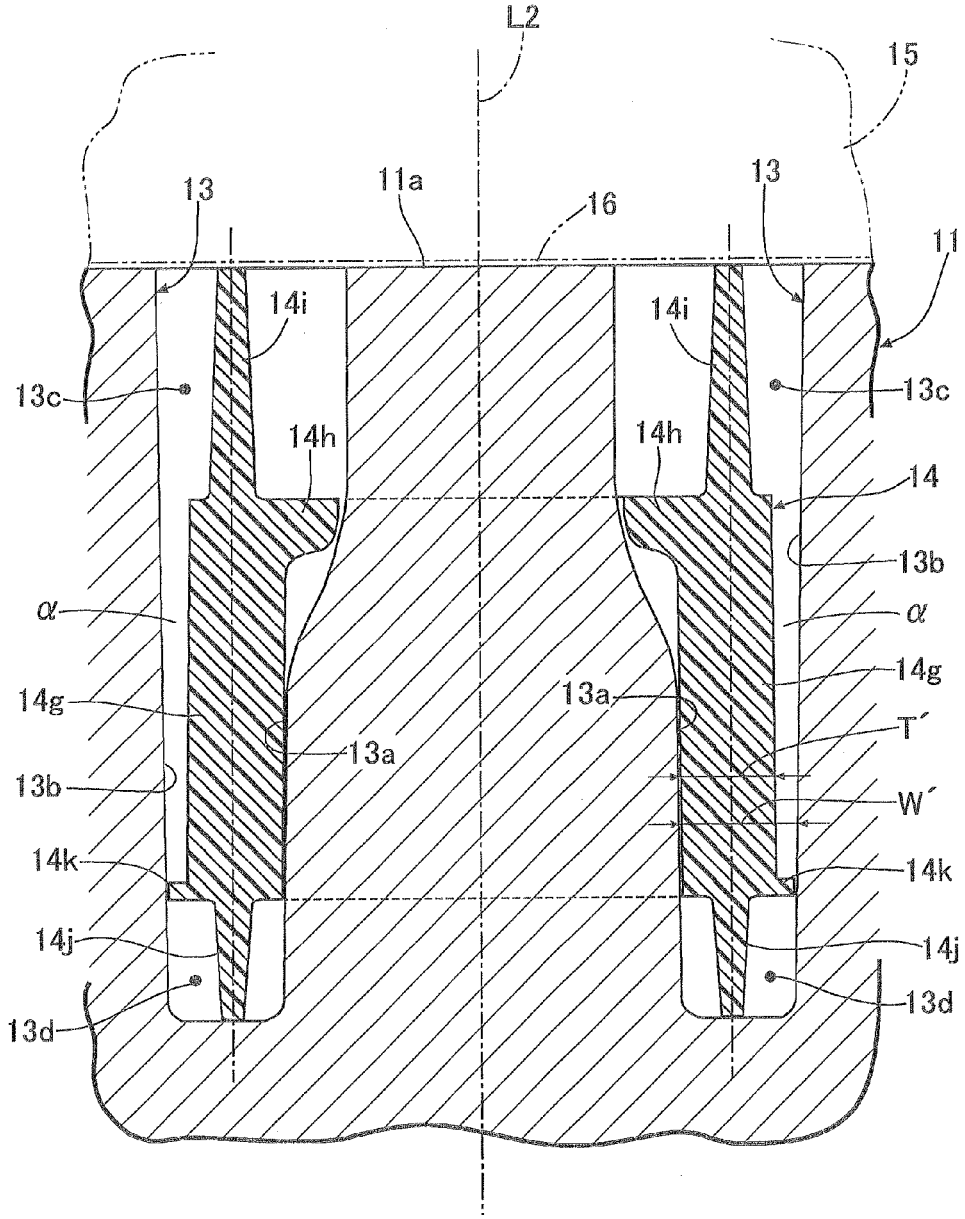
Figure 19:
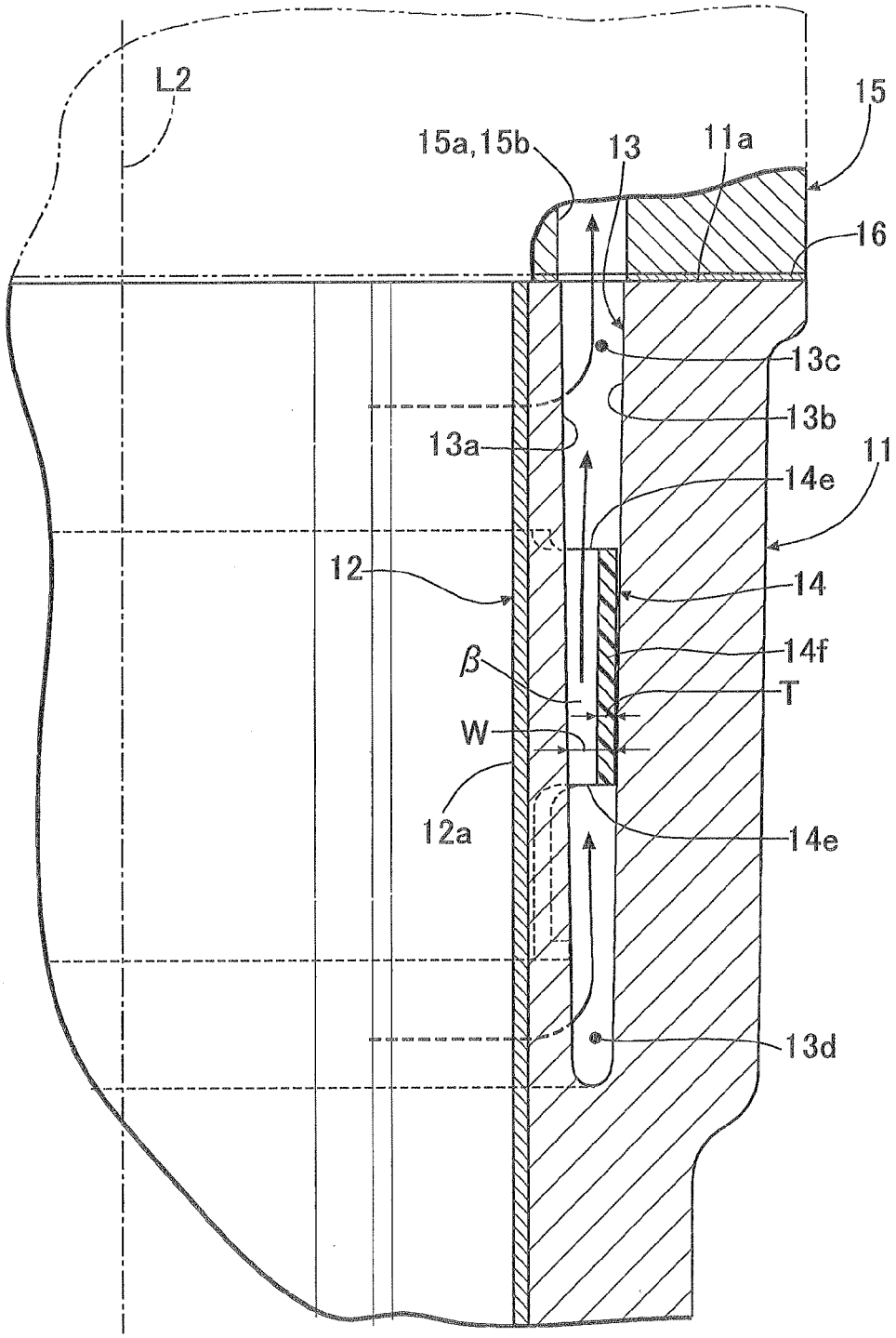

As clear from FIGS. 14, 16 and 18, in the vicinity of each area where two of the three cylinder bores 12*a* are adjacent to each other, portions of the water jacket 13 around the respective two cylinder bores 12*a* intersect at an acute angle. For this reason, the width W' (refer to FIG. 18) of the water jacket 13 in a direction orthogonal to the cylinder row line L1 in the area is wider than the width W (refer to FIGS. 17 and 19) of the water jacket 13 in any other area. Accordingly, the thickness T' (refer to FIG. 18) of each connecting portion 14*g* of the spacer main body part 14*a* which is fitted in the corresponding area where portions of the water jacket 13 intersect at the acute angle is wider than the thickness T (refer to FIGS. 17 and 19) of any other part of the spacer main body part 14*a*. The width W' of the water jacket 13 in portions in which the connecting portions 14*g* are accommodated becomes wider toward its portions continuing to the cylinder head 15, respectively. Projections 14*h* are provided projecting inward in the radial direction from the upper ends of the connecting portions 14*g* to occlude the wider portions, respectively (refer to FIG. 18).

Two truncated cone-shaped upper support legs 14*i*, 14*i* project upward, and two truncated cone-shaped lower support legs 14*j*, 14*j* project downward, from the respective two connecting portions 14*g*, 14*g* of the spacer main body part 14*a* which are adjacent to an area where two adjacent cylinder bores 12*a*, one of which is the closet to a transmission-side end portion of the cylinder block 11, face each other. The upper ends of the upper support legs 14*i*, 14*i* and the upper end of the partition wall 14*b* are arranged at the same height. The lower ends of the lower support legs 14*j*, 14*j* and the lower end of the partition wall 14*b* are arranged at the same height.

As described above, the upper support legs 14*i*, 14*i* and the lower support legs 14*j*, 14*j* are provided to the connecting portions 14*g*, 14*g* whose thickness T' is larger than the thickness T of any other part of the spacer main body part 14*a*. This increases the strength of the connection of the upper support legs 14*i*, 14*i* and the lower support legs 14*j*, 14*j* to the spacer main body part 14*a*. Accordingly, the spacer 14 can be firmly supported inside the water jacket 13 by the upper support legs 14*i*, 14*i* and the lower support legs 14*j*, 14*j*. In addition, positions at which the upper support legs 14*i*, 14*i* and the lower support legs 14*j*, 14*j* are provided are positions where the flow speed of the cooling water decreases due to change in the direction of the flow of the cooling water inside the water jacket 13. For this reason, the influence of the placement of the upper support legs 14*i*, 14*i* and the lower support legs 14*j*, 14*j* on the flow of the cooling water can be suppressed to a minimum.

Here, as clear from FIG. 14, communication holes 15*c* for supplying part of the cooling water in the water jacket 13 of the cylinder block 11 to the water jacket 13 of the cylinder head 15 are opened in the undersurface of the cylinder head 15 which faces the tops of the connecting portions 14*g* of the spacer 14. The two upper support legs 14*i*, 14*i* provided to the two connecting portions 14*g*, 14*g* are arranged slightly offset downstream in the direction of the flow of the cooling water from the communications holes 15*c*, 15*c*, respectively. Thereby, the cooling water is made to run against the upper support legs 14*i*, 14*i*, and is easily supplied to the communication holes 15*c*, 15*c*.

Accordingly, once the spacer 14 is fitted inside the water jacket 13, the lower end of the partition wall 14*b* contacts the bottom wall of the water jacket 13, and the upper end of the partition wall 14*b* contacts the undersurface of a gasket 16 held between the cylinder block 11 and the cylinder head 15. Thereby, the timing train-side end portion of the spacer 14 is positioned in the up-and-down direction (refer to FIG. 21). In addition, the lower ends of the lower support legs 14*j*, 14*j* contact the bottom wall of the water jacket 13, and the upper ends of the upper support legs 14*i*, 14*i* contact the undersurface of the gasket 16. Thereby, the transmission-side portion of the spacer 14 is positioned in the up-and-down direction (refer to FIGS. 16 and 18).

Furthermore, inside the water jacket 13, an upper cooling water passage 13*c* is defined between the upper edge of the spacer 14 and the undersurface of the gasket 16, and a lower cooling water passage 13*d* is defined between the lower edge of the spacer 14 and the bottom portion of the water jacket 13. In this respect, the height of the upper cooling water passage 13*c* is determined by the height of the upper support legs 14*c*, 14*c*, and the height of the lower cooling water passage 13*d* is determined by the height of the lower support legs 14*j*, 14*j*.

Hereinbelow, descriptions will be sequentially provided for the detailed structure of the spacer 14.

As clear from FIGS. 16 to 18, the thickness T (refer to FIG. 17) of the spacer main body part 14*a* in the radial direction is constant in the up-and-down direction, and is set smaller than the width W of the water jacket 13 in the radial direction. When the spacer 14 is fitted inside the water jacket 13, the inner peripheral surface of the spacer main body part 14*a* is opposed to an inner wall surface 13*a* of the water jacket 13 with a slight space interposed in between. Accordingly, a larger space α is formed between the outer peripheral surface of the spacer main body part 14*a* and an outer wall surface 13*b* of the water jacket 13.

As clear from FIGS. 13 and 15 to 18, a ridge-shaped projecting strip 14*k* is provided along the lower edge of the outer peripheral surface of the spacer main body part 14*a* to project outward in the radial direction. The radial-direction outer end of this projecting strip 14*k* is opposed to the outer wall surface 13*b* of the water jacket 13 with a slight space interposed in between. Accordingly, the spacer main body part 14*a* is positioned in the radial direction in the lower edge where the projecting strip 14*k* is formed. Note that no portion of the projecting strip 14*k* is provided in a portion of the lower inlet port cutout 14*c* or in a portion of the lower outlet port cutout 14*e*.

As clear from FIGS. 14 and 20 to 22, a cooling water supply passage 11*b* extending in parallel to the cylinder row line L1 is formed in the timing train-side end portion of the cylinder block 11. The downstream end of this cooling water supply passage 11*b* communicates with the water jacket 13 via a circular cooling water supply port 11*c* in the intake side of the partition wall 14*b* of the spacer 14. The cooling water supply port 11*c* of the cylinder block 11 and the cooling water inlet port part 14*d* of the spacer 14 are provided slightly offset to the intake side from the cylinder row line L1. For this reason, the cooling water supplied from the cooling water supply passage 11*b* in parallel to the cylinder row line L1 can smoothly flow into the water jacket 13 in the intake side without greatly changing the direction of its flow. Moreover, because, as described above, the inlet port cutouts 14*c*, 14*c* of the cooling water inlet port part 14*d* respectively continue to the upper edge and lower edge of the spacer main body part 14*a* while smoothly curving, the cooling water flowing therein from the cooling water supply port 11*c* is guided by the inlet port cutouts 14*c*, 14*c* of the cooling water inlet port part 14*d*, and is smoothly introduced to the upper cooling water passage 13*c* and the lower cooling water passage 13*d*.

The cooling water inlet port part 14*d*, whose width is narrow as a result of being vertically interposed between the upper and lower inlet port cutouts 14*c*, 14*c* of the spacer 14, has a triangular cross section, and projects toward the cooling water supply port 11*c* like a wedge. When looking at the cooling water supply port 11*c* from the inside of the cooling water supply passage 11*b*, the ridge line of the cooling water inlet port part 14*d* with the triangular cross section in the spacer 14 is exposed (refer to FIG. 22). The height H1 of the cooling water inlet port part 14*d* in the cylinder axis line L2 direction is set smaller than the height H3 of the cooling water supply port 11*c* in the cylinder axis line L2 direction.

As clear from FIGS. 13, 14, 16, 19 and 20, the spacer main body part 14*a* of the spacer 14 is arranged along the inner wall surface 13*a* of the water jacket 13. However, only the cooling water outlet port part 14*f* of the spacer 14, which is interposed vertically between the upper and lower outlet port cutouts 14*e*, 14*e*, juts out in the radial direction, and this part of the cooling water outlet port part 14*f* is arranged along the outer wall surface 13*b* of the water jacket 13. Accordingly, a space β (refer to FIGS. 14 and 20) is formed between the cooling water outlet port part 14*f* of the spacer 14 and the inner wall surface 13*a* of the water jacket 13. In addition, two communication holes 15*a*, 15*b* (refer to FIGS. 14, 16 and 19) opened in the undersurface of the cylinder head 15 face the top of the cooling water outlet port part 14*f* of the spacer 14.

Figure 20:
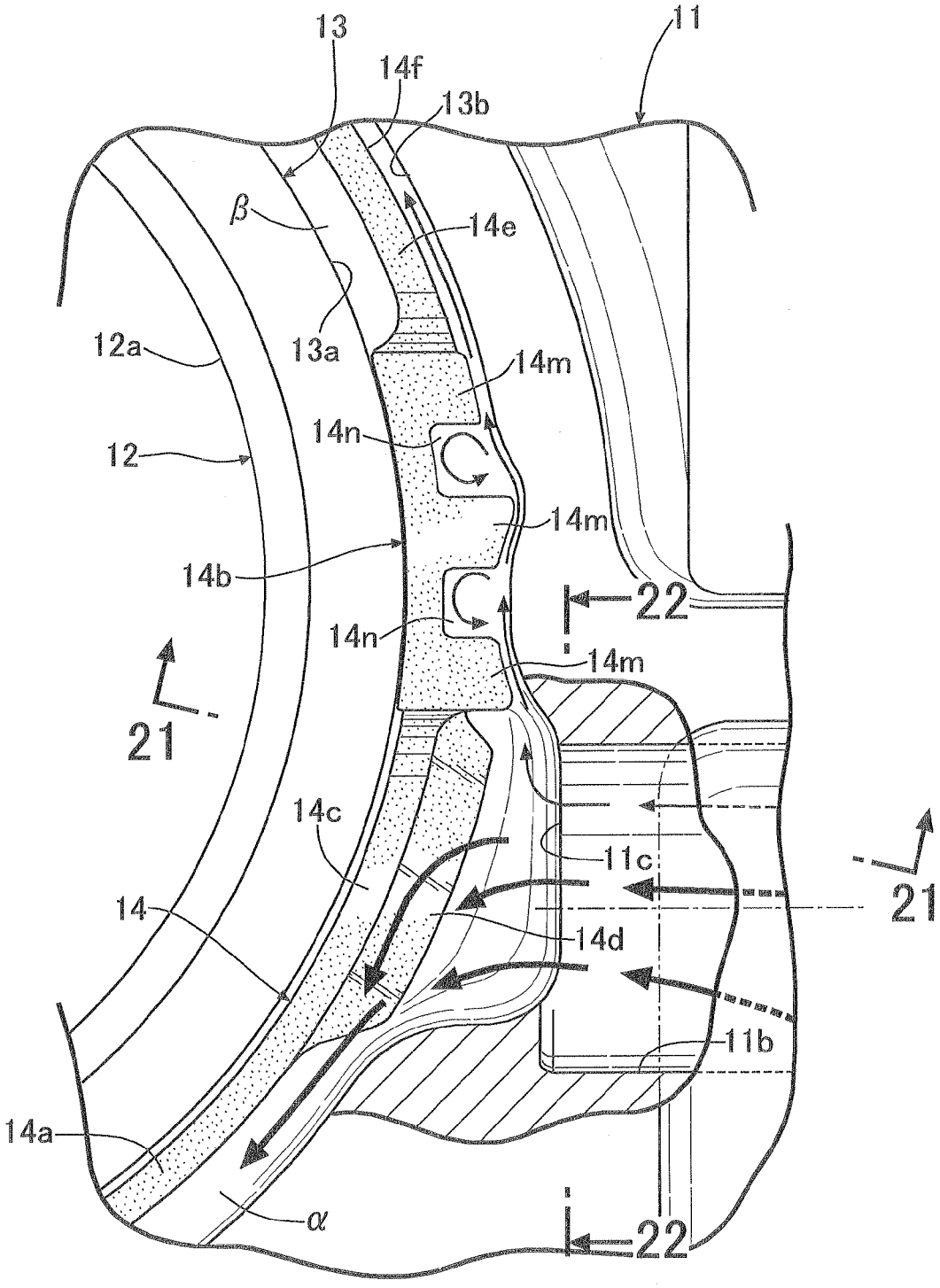
Figure 21:
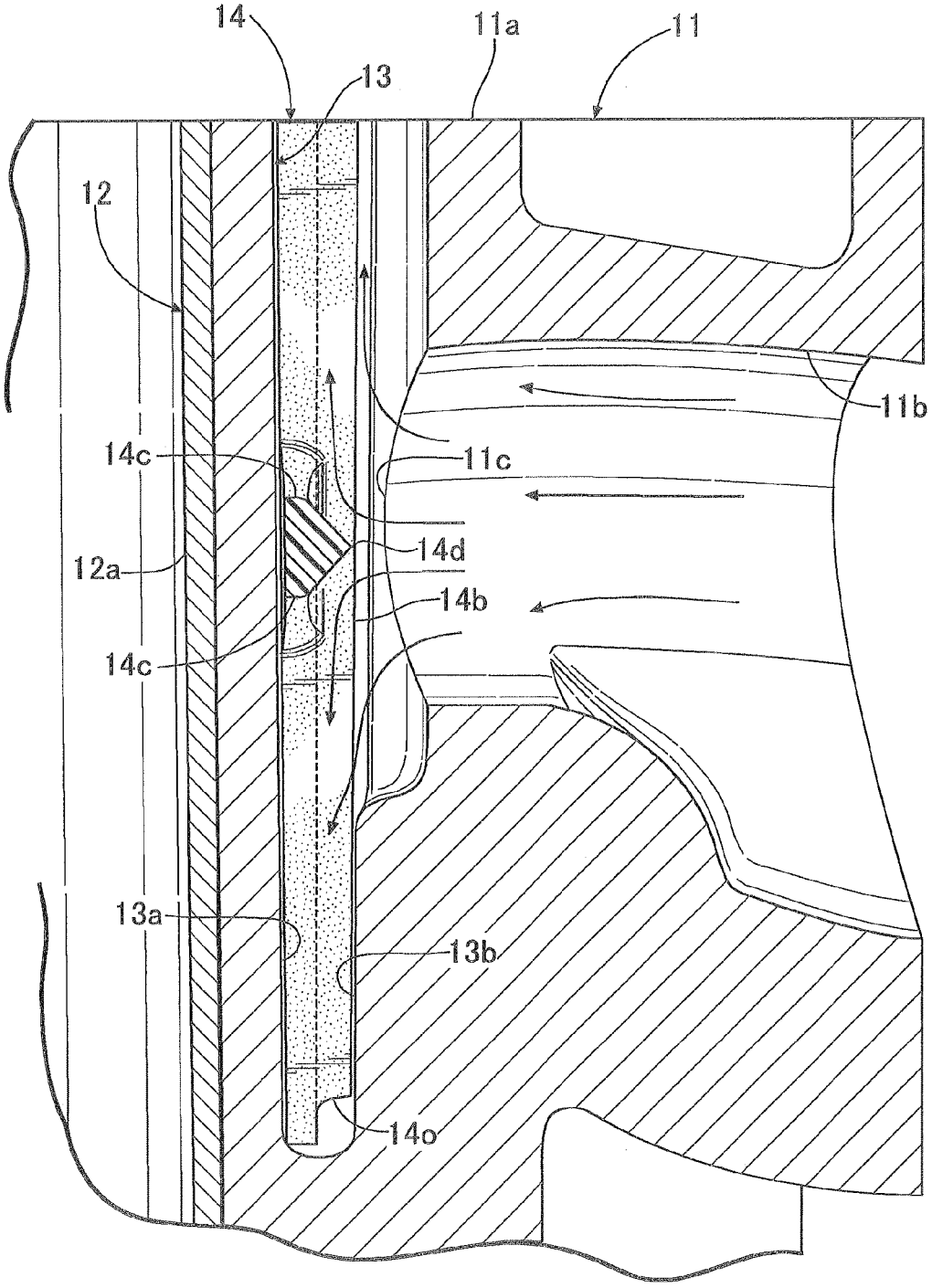
Figure 22:
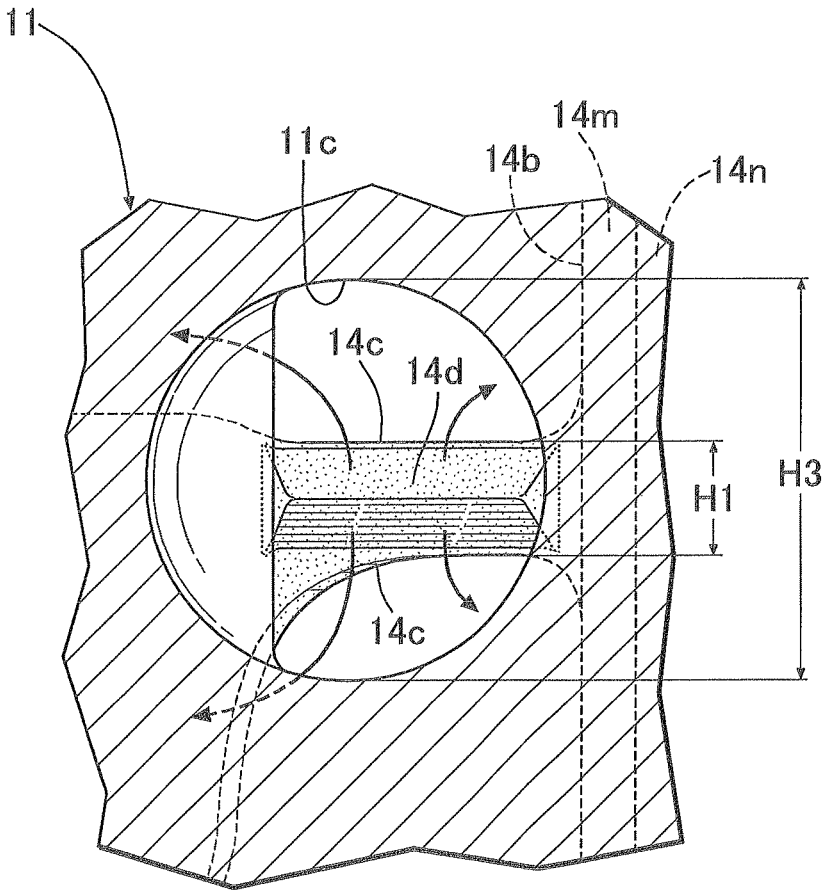

As clear from FIGS. 13, 16 and 20, three ribs 14*m* extending in the up-and-down direction and two grooves 14*n*, 14*n* interleaved between the three ribs 14*m* are formed in the outer surface of the partition wall 14*b* of the spacer 14. The outer wall surface 13*b* of the water jacket 13 facing the tip ends of the respective three ribs 14*m* is not a simple arc surface, but curves wavingly (refer to FIG. 20). A cutout 14*o* is formed in the lower end of the outer surface of the partition wall 14*b*. Parts of the water jacket 13 on the respective opposite sides of the partition wall 14*b* communicate with each other through this cutout 14*o*.

Next, descriptions will be provided for the operation of the second embodiment of the present invention which is provided with the above-described configuration.

Before the cylinder head 15 is assembled to the deck surface 11*a* of the cylinder block 11, the water jacket 13 is opened to surround the outer peripheries of the cylinder bores 12*a* of the three cylinder sleeves 12 exposed to the deck surface 11*a*, respectively. The spacer 14 is inserted inside the water jacket 13 from the opening. Thereafter, the cylinder head 15 is fastened to the cylinder block 11 with the gasket 16 overlapping the deck surface 11*a* of the cylinder block 11.

When this spacer 14 is assembled therein, the lower end of the partition wall 14*b* and the lower ends of the lower support legs 14*j*, 14*j* are in contact with the bottom surface of the water jacket 13, and the upper end of the partition wall 14*b* and the upper ends of the upper support legs 14*i*, 14*i* are in contact with the undersurface of the gasket 16. Thereby, the spacer 14 is positioned in the cylinder axis line L2 direction. At this time, the inner peripheral surface of the spacer main body part 14*a* of the spacer 14 is arranged to contact the inner wall surface 13*a* of the water jacket 13. However, because the dimensional precision of the inner wall surface 13*a* of the water jacket 13 which has been subjected to no process since casted is not high, a slight space is formed between the inner peripheral surface of the spacer main body part 14*a* and the inner wall surface 13*a* of the water jacket 13 for the purpose of preventing the assemblability from deteriorating due to friction of the spacer 14 with the inner wall surface 13*a* of the water jacket 13.

During the operation of the internal combustion engine, the cooling water supplied from a water pump (not illustrated) provided in the cylinder block 11 flows into the water jacket 13 from the cooling water supply passage 11*b* provided in the timing train-side end portion of the cylinder block 11 via the cooling water supply port 11*c*. The spacer 14 is arranged inside the water jacket 13, and the cooling water inlet port part 14*d*, whose width is narrow as a result of being interposed between the upper and lower inlet port cutouts 14*c*, 14*c*, is opposed to the spacer 14 facing the cooling water supply port 11*c*. As clear from FIGS. 20 to 22, the height H1 of the cooling water inlet port part 14*d* in the cylinder axis line L2 direction is set smaller than the height H3 of the cooling water supply port 11*c* in the cylinder axis line L2 direction, and the cooling water inlet port part 14*d* with the triangular cross section projects toward the cooling water supply port 11*c* like a wedge. For these reasons, the cooling water having come out of the cooling water supply port 11*c* is guided by the upper and lower slopes of the cooling water inlet port part 14*d*, and is bifurcated in the up-and-down direction. Accordingly, the bifurcated parts of the cooling water can smoothly flow into the upper cooling water passage 13*c* and the lower cooling water passage 13*d* which are separated by the spacer 14, respectively. Thus, the pressure loss at this time is suppressed to a minimum.

For the purpose of decreasing the pressure loss more when the cooling water flows into the water jacket 13, the cooling water inlet port part 14*d* may be completely cut away in order for the spacer 14 to be separated by the cut-away portion. However, in this case, a problem occurs in which the rigidity of the spacer 14 decreases to a large extent. In contrast to this, the present embodiment makes it possible to secure the rigidity of the spacer 14 while reducing the pressure loss of the cooling water by use of the cooling water inlet port part 14*d* whose height H1 in the up-and-down direction is reduced.

The cooling water having flown into the upper cooling water passage 13*c* and the lower cooling water passage 13*d* of the water jacket 13 tends to bifurcate in the left and right directions. However, the flow of the cooling water is inhibited by the partition wall 14*b* existing on the right of the cooling water inlet port part 14*d*. For this reason, the cooling water turns the direction of its flow to the left, and thus flows counterclockwise in the upper cooling water passage 13*c* and the lower cooling water passage 13*d* in almost full length. The cooling water is discharged to the communication holes 15*a*, 15*b* in the cylinder head 15 from the cooling water outlet port part 14*f* which is situated on the opposite side of the partition wall 14*b* from the cooling water supply port 11*c*. At this time, the cooling water flowing in the upper cooling water passage 13*c* and the cooling water flowing in the lower cooling water passage 13*d* hardly ever mingle with each other, because the upper cooling water passage 13*c* and the lower cooling water passage 13*d* are partitioned by the projecting strip 14*k* provided along the lower edge of the spacer main body part 14*a*.

Because the inner peripheral surface of the spacer main body part 14*a* of the spacer 14 is in contact with a portion of the inner wall surface 13*a* which corresponds to the intermediate portion of the water jacket 13 in the cylinder axis line L2 direction, it is hard for the cooling water to contact the inner wall surface 13*a*, and the cooling is accordingly suppressed. As a result, the intermediate portions of the cylinder bores 12*a* in the cylinder axis line L2 direction, which are opposed to the spacer main body part 14*a*, become higher in temperature than any other portions thereof, and thermally expand. Accordingly, the clearances between the cylinder bores 12*a* and their corresponding pistons increase. As a consequence, frictions between the pistons and the cylinder bores 12*a* are reduced, particularly when large side thrusts are applied to the respective pistons during the compression process and the expansion process. Accordingly, it is possible to contribute to improving fuel efficiency of the internal combustion engine. Furthermore, because the intermediate portions of the cylinder bores 12*a* in the cylinder axis line L2 direction become higher in temperature than any other portions thereof, the temperature of the oil lubricating such portions rises, and the viscosity of the oil accordingly decreases. For this reason, the effect of friction reduction is enhanced more.

On the other hand, because the upper portions and lower portions of the cylinder bores 12*a* in the cylinder axis line L2 direction are sufficiently cooled by the cooling water flowing in the upper cooling water passage 13*c* and the lower cooling water passage 13*d* above and under the spacer 14, it is possible to secure the cooling performances of the top parts and the skirt parts of the pistons slidably fitted in the cylinder bores 12*a*, and to prevent their overheat, although the temperatures of the top parts and the skirt parts would otherwise tend to rise.

A portion of the cooling water having flown into the water jacket 13 from the cooling water supply port 11*c* of the cylinder block 11 tends to take a shortcut from the cooling water inlet port part 14*d* to the cooling water outlet port part 14*f* by passing between the outer surface of the partition wall 14*b* of the spacer 14 and the outer wall surface 13*b* of the water jacket 13. However, because, as shown in FIG. 20, the outer surface of the partition wall 14*b* of the spacer 14 has the labyrinth structure in which the three ribs 14*m* and the two grooves 14*n*, 14*n* are alternately arranged, the cooling water having passed the space outside the ribs 14*m* swirl inside the grooves 14*n*. Thereby, it is hard for the cooling water to pass the partition wall 14*b*. For this reason, although the space is formed between the outer surface of the spacer 14 and the outer wall surface 13*b* of the water jacket 13 for the purpose of securing the assemblability of the spacer 14, it is possible to effectively prevent a shortcut between the cooling water supply port 11*c* and the communication holes 15*a*, 15*b* through the space.

Moreover, because the outer wall surface 13*b* of the water jacket 13, which is opposed to the outer surface of the partition wall 14*b* of the spacer 14, curves wavingly (refer to FIG. 20), the labyrinth effect is exerted more strongly. Thereby, it is possible to prevent the cooling water from taking a shortcut more effectively.

The cooling water having flown in the upper cooling water passage 13*c* of the water jacket 13 and the cooling water having flown in the lower cooling water passage 13*d* of the water jacket 13 flow together in the cooling water outlet port part 14*f* of the spacer 14, change their direction upward there, pass the communication holes 15*a*, 15*b* in the cylinder head 15, and are supplied to the water jacket in the cylinder head 15. At this time, the cooling water having come out of the lower cooling water passage 13*d* passes the space β (refer to FIGS. 14 and 20) between the cooling water outlet port part 14*f* of the spacer 14 and the outer wall surface 13*b* of the water jacket 13, and is smoothly guided to the communication holes 15*a*, 15*b* in the cylinder head 15, because: the height H2 of the cooling water outlet port part 14*f* of the spacer 14 in the cylinder axis line L2 direction is formed smaller than the height H0 of the spacer main body part 14*a* in the cylinder axis line L2 direction; and the cooling water outlet port part 14*f* is arranged offset outward in the radial direction to contact the outer wall surface 13*b* of the water jacket 13. In this event, it is possible to reduce the friction which occurs when the cooling water flowing from the lower cooling water passage 13*d* to the communication holes 15*a*, 15*b* passes the cooling water outlet port part 14*f*, because the height H2 of the cooling water outlet port part 14*f* is smaller than the height H0 of the spacer main body part 14*a*.

Figure 23A:
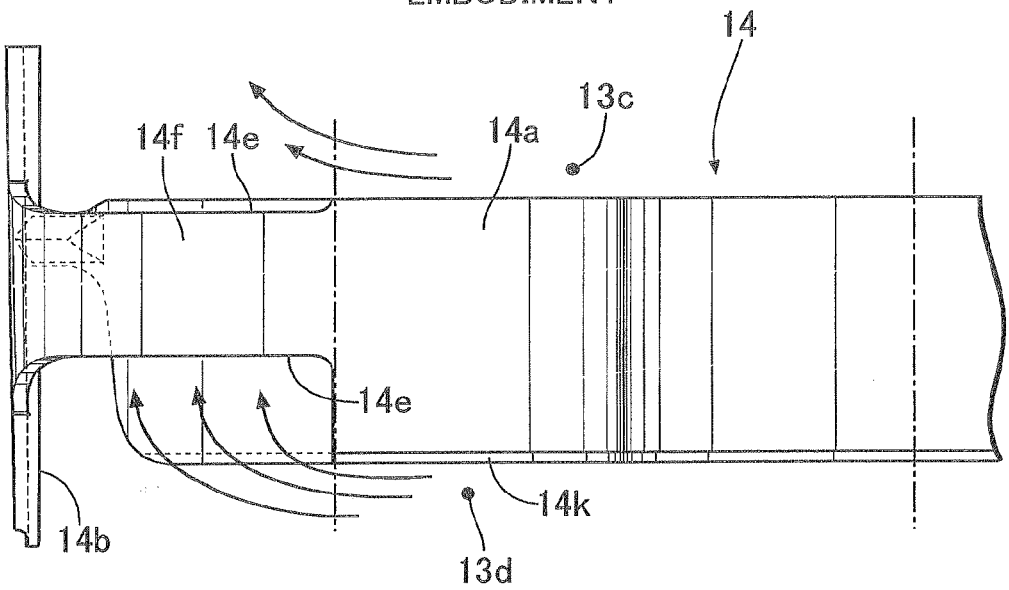
FIG. 23A is a view related to the second embodiment and seen from a direction of an arrow 23 in FIG. 16.
Figure 23B:
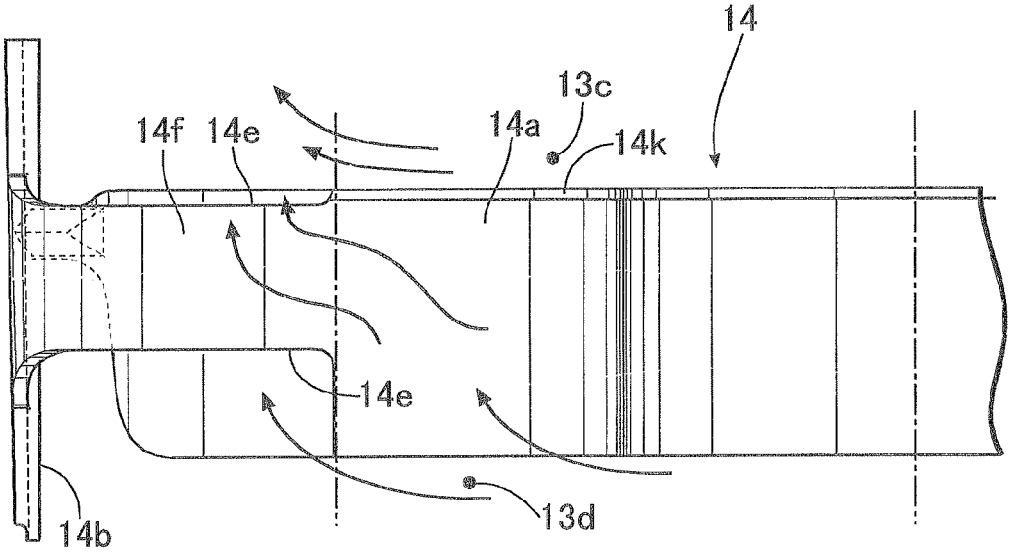

Even in a case where, as shown in FIG. 23B, the projecting strip 14*k* of the spacer 14 is provided along the upper edge of the spacer main body part 14*a*, the effect of partitioning the upper cooling water passage 13*c* and the lower cooling water passage 13*d* by the projecting strip 14*k* remains unchanged. However, a difference occurs in the behavior of the cooling water in an area where the projecting strip 14*k* discontinues in the cooling water outlet port part 14*f* of the spacer 14. To put it specifically, in a case where, as shown in FIG. 23A, the projecting strip 14*k* of the spacer 14 is provided along the lower edge of the spacer main body part 14*a* as in the present embodiment, the cooling water flows in the horizontal direction up to an area immediately near the cooling water outlet port part 14*f*, then changes its flow upward in the area where the projecting strip 14*k* discontinues, and is smoothly guided to the communication holes 15*a*, 15*b* in the cylinder head 15. Thereby, a sufficient amount of cooling water is supplied to the lower cooling water passage 13*d* under the cooling water outlet port part 14*f* as well, and the entire periphery of the cylinder bore 12*a* facing the cooling water outlet port part 14*f* can be cooled uniformly.

On the other hand, in the case where, as shown in FIG. 23B, the projecting strip 14*k* of the spacer 14 is provided along the upper edge of the spacer main body part 14*a*, the cooling water starts to change its flow upward at an area not close to the cooling water outlet port part 14*f*. For this reason, a problem arises in which: a sufficient amount of cooling water does not flow to the lower cooling water passage 13*d* under the cooling water outlet port part 14*f*; and the cooling performance deteriorates.

It should be noted that: because the cutout 14*o* (refer to FIGS. 12 and 21) is provided in the lower end of the partition wall 14*b* of the spacer 14, a portion of the cooling water under the cooling water inlet port part 14*d* passes the cutout 14*o*, then flows into an area under the cooling water outlet port part 14*f*, and thus exerts an effect of pushing up the cooling water, which stays in the cooling water outlet port part 14*f*, toward the communication holes 15*a*, 15*b* in the cylinder head 15. Thereby, the discharge of the cooling water from the water jacket 13 is achieved more smoothly.

Furthermore, with regard to the spacer 14 inserted inside the water jacket 13, the lower end of the partition wall 14*b* contacts the bottom wall of the water jacket 13, and the upper end of the partition wall 14*b* contacts the undersurface of the gasket 16 held between the cylinder block 11 and the cylinder head 15. Thereby, the timing train-side end portion of the spacer 14 is positioned in the up-and-down direction (refer to FIG. 21). In addition, the lower ends of the lower support legs 14*j*, 14*j* contact the bottom wall of the water jacket 13, and the upper ends of the upper support legs 14*i*, 14*i* contact the undersurface of the gasket 16. Thereby, the transmission-side portion of the spacer 14 is positioned in the up-and-down direction. Because the partition wall 14*b* is provided in one end portion in the cylinder row line L1 direction while the upper support legs 14*i*, 14*i* and the lower support legs 14*j*, 14*j* are respectively provided in the connecting portions 14*g*, 14*g* between the farthest cylinder bore 12*a* in the other end portion in the cylinder row line L1 direction and the cylinder bore 12*a* which is second from the farthest cylinder bore 12*a*, the supporting of the spacer 14 can be stabilized by securing the distance from the partition wall 14*b* to the upper support legs 14*i*, 14*i* and the lower support legs 14*j*, 14*j* to the maximum.

In addition, because the upper support legs 14*i*, 14*i* and the lower support legs 14*j*, 14*j* are provided to the connecting portions 14*g*, 14*g* of the spacer 14, the influence of the providing of the upper support legs 14*i*, 14*i* and the lower support legs 14*j*, 14*j* on the flow of the cooling water of the water jacket 13 can be suppressed to a minimum.

The reason for this is as follows. In each of the connecting portions 14*g*, 14*g*, the portions of the spacer main body part 14*a* extending in the respective two different directions intersect at the acute angle. Thereby, the width W' (refer to FIG. 18) of the water jacket 13 in the direction orthogonal to the cylinder row line L1 is larger in each connecting portions 14*g*, 14*g* than the width W (refer to FIGS. 17 and 19) of the water jacket 13 in the general portions excluding the connecting portions 14*g*, 14*g*. Accordingly, when the upper support legs 14*i*, 14*i* and the lower support legs 14*j*, 14*j* are disposed in the respective areas where the width W' of the water jacket 13 is larger, the influence of the disposition on the flow of the cooling water of the water jacket 13 can be suppressed to a minimum.

Figure 24:
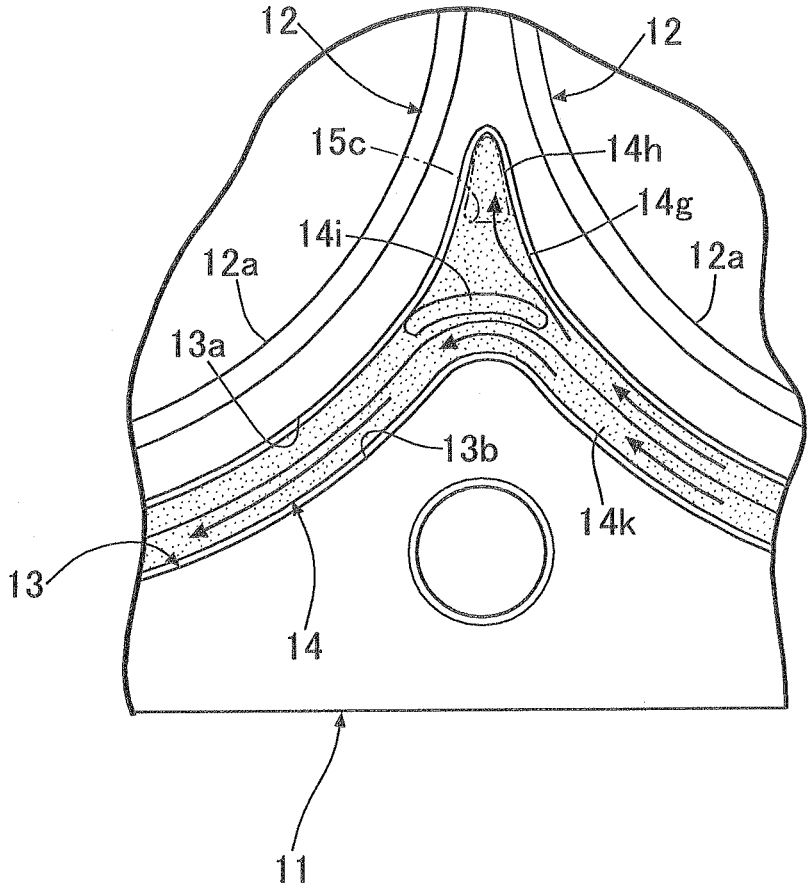
FIG. 24 is a view showing an upper support leg according to a third embodiment.

Next, descriptions will be provided for a third embodiment of the present invention on the basis of FIG. 24.

In the second embodiment, the upper support legs 14*i*, 14*i* are each shaped like a pin having a circular cross section. On the other hand, in the third embodiment, the upper support legs 14*i*, 14*i* are each shaped like a plate curving along the flow of the cooling water. This makes it hard for the cooling water flowing in the upper cooling water passage 13*c* to be obstructed by the upper support legs 14*i*, 14*i*. Furthermore, the upper support legs 14*i*, 14*i* are offset downstream in the direction of the flow of the cooling water from the respective connection holes 15, 15*c* in the cylinder head 15 facing the connecting portions 14*g*, 14*g*. This makes it possible to smoothly supply the cooing water to the connection holes 15*c*, 15*c* as in the second embodiment. Note that, like the upper support legs 14*i*, 14*i*, the lower support legs 14*j*, 14*j* may be each shaped like the plate.

The foregoing descriptions have been provided for the embodiments of the present invention. However, the present invention may be implemented with various design modifications within the scope not departing from the gist of the present invention.

For example, although the internal combustion engine with four cylinders mounted in a straight line and the V-type internal combustion engine with six cylinders have been shown as the first to third embodiments, the present invention can be applied to an internal combustion engine of any arbitrary mode having any arbitrary number of cylinders.

Furthermore, the present invention can be applied to an internal combustion engine in which: the cooling water supplied from one end side in the cylinder row line L1 is bifurcated into two streams respectively flowing along the intake-side side surface and the exhaust-side side surface; the two streams are made confluent in, and discharged from, the other end side in the cylinder row line L1.

Moreover, although in the first embodiment both the upper support legs 14*e*, 14*g* and the lower support legs 14*f*, 14*h* are provided, the upper support legs 14*e*, 14*g* are not necessarily provided.

Further, although in the first embodiment the upper support legs 14*e*, 14*g* and the lower support legs 14*f*, 14*h* of the spacer 14 are provided in the respective opposite end portions in the cylinder row line L1 direction, those may be provided in only one end portion in the cylinder row line L1 direction.

In addition, although in the first embodiment the fixing members 22, 22 are provided in the respective opposite end portions of the spacer 14 in the cylinder row line L1 direction, only one fixing member 22 may be provided in only one end portion thereof in the cylinder row line L1 direction, and the positions where the respective fixing members 22, 22 are provided may be offset from the cylinder row line L1 is some degree.

What is claimed is:

1. A cooling structure for an internal combustion engine, in which:

a spacer is fitted inside a water jacket which is formed to surround peripheries of a plurality of cylinder bores arranged one after another on a cylinder row line of a cylinder block of the internal combustion engine; and a cooling condition of the cylinder bores is controlled by regulating a flow of cooling water in the water jacket by use of the spacer, wherein the spacer comprises a spacer main body surrounding the peripheries of the cylinder bores and a fixing part projecting from said spacer main body in a cylinder-axis line direction, wherein the fixing part fixes the spacer inside the water jacket;

wherein the fixing part is configured such that it is thinner in a radial direction than a thickness of the spacer, such that the influence of the fixing part on the flow of the cooling water is small;

wherein the fixing part extends upwardly from an upper end face of the spacer main body or downwardly from a lower end face of the spacer main body in the cylinder-axis line direction; and wherein the fixing part extends partly in a direction peripheral to the cylinder bores so as to permit flow of cooling water between an inner wall surface and an outer wall surface of the water jacket.

2. The cooling structure for an internal combustion engine according to claim 1, wherein the fixing part is disposed in an end portion in a direction of the cylinder row line, or in a connecting portion of the spacer main body which faces an area where two of the cylinder bores are adjacent to each other.

3. The cooling structure for an internal combustion engine according to claim 2, wherein the spacer comprises a support leg which regulates the flow of the cooling water in the water jacket, and which forms the fixing part, and the support leg is disposed in the end portion in the cylinder row line direction.

4. The cooling structure for an internal combustion engine according to claim 3, wherein the support leg curves so as to form an arc-shape along the inner wall surface or the outer wall surface of the water jacket.

5. The cooling structure for an internal combustion engine according to claim 3 or 4, wherein the support leg is disposed offset toward the inner wall surface of the water jacket.

6. The cooling structure for an internal combustion engine according to claim 2, wherein the spacer comprises a support leg which regulates the flow of the cooling water in the water jacket, and which forms the fixing part, and the support leg is disposed in the connecting portion of the spacer main body which faces the area where the two cylinder bores are adjacent to each other.

7. The cooling structure for an internal combustion engine according to claim 6, wherein a passage width of the water jacket is larger in an area where the connecting portion is disposed than in any other area.

8. The cooling structure for an internal combustion engine according to claim 2, wherein a fixing member for fixing the spacer inside the water jacket is provided in an end portion of the spacer in the cylinder row line direction.

9. The cooling structure for an internal combustion engine according to claim 8, wherein the fixing member is provided in each of the opposite end portions of the spacer in the cylinder row line direction, and is put in pressure contact with the inner wall surface of the water jacket.

10. The cooling structure for an internal combustion engine according to claim 9, wherein the fixing members are each made of an elastic body.

11. The cooling structure for an internal combustion engine according to claim 8, 9 or 10, wherein the fixing members are symmetrically disposed in the respective opposite end portions in the cylinder row line direction.

12. The cooling structure for an internal combustion engine according to claim 8, 9 or 10, wherein the spacer main body separates the water jacket into an upper cooling water passage and a lower cooling water passage, and the fixing member is provided to the spacer main body.

13. The cooling structure for an internal combustion engine according to claim 8, 9 or 10, wherein the spacer comprises a lower support leg which extends downward from the fixing member, and which contacts a bottom portion of the water jacket.

14. A cooling structure for an internal combustion engine, in which: a spacer is fitted inside a water jacket which is formed to surround peripheries of a plurality of cylinder bores arranged one after another on a cylinder row line of a cylinder block of the internal combustion engine; and a cooling condition of the cylinder bores is controlled by regulating a flow of cooling water in the water jacket by use of the spacer, wherein the spacer comprises a fixing part which is disposed in an area where influence of the fixing part on the flow of the cooling water is small and which fixes the spacer inside the water jacket, the fixing part is disposed in an end portion in a direction of the cylinder row line, or in a connecting portion of a spacer main body part which faces an area where two of the cylinder bores are adjacent to each other, the spacer comprises a support leg which extends in an up-and-down direction from the spacer main body part for regulating the flow of the cooling water in the water jacket, and which forms the fixing part, the support leg is disposed in the connecting portion of the spacer main body part which faces the area where the two cylinder bores are adjacent to each other, the spacer comprises a partition wall which extends from the spacer main body part in the up-and-down direction on one of opposite end sides in the cylinder row line direction, and which partitions between a cooling water supply port and a cooling water discharge port of the water jacket, and the support leg is disposed in the connecting portion closest to the other of the opposite end sides in the cylinder row line direction.

15. A cooling structure for an internal combustion engine, in which: a spacer is fitted inside a water jacket which is formed to surround peripheries of a plurality of cylinder bores arranged one after another on a cylinder row line of a cylinder block of the internal combustion engine; and a cooling condition of the cylinder bores is controlled by regulating a flow of cooling water in the water jacket by use of the spacer, wherein the spacer comprises a fixing part which is disposed in an area where influence of the fixing part on the flow of the cooling water is small and which fixes the spacer inside the water jacket, the fixing part is disposed in an end portion in a direction of the cylinder row line, or in a connecting portion of a spacer main body part which faces an area where two of the cylinder bores are adjacent to each other, the spacer comprises a support leg which extends in an up-and-down direction from the spacer main body part for regulating the flow of the cooling water in the water jacket, and which forms the fixing part, the support leg is disposed in the connecting portion of the spacer main body part which faces the area where the two cylinder bores are adjacent to each other.

a passage width of the water jacket is larger in an area where the connecting portion is disposed than in any other area, the spacer comprises a partition wall which extends from the spacer main body part in the up-and-down direction on one of opposite end sides in the cylinder row line direction, and which partitions between a cooling water supply port and a cooling water discharge port of the water jacket, and the support leg is disposed in the connecting portion closest to the other of the opposite end sides in the cylinder row line direction.

* * * * *